US007018273B1

(12) United States Patent
Kiermasz et al.

(10) Patent No.: US 7,018,273 B1
(45) Date of Patent: Mar. 28, 2006

(54) PLATEN WITH DIAPHRAGM AND METHOD FOR OPTIMIZING WAFER POLISHING

(75) Inventors: Adrian Kiermasz, Union City, CA (US); Miguel A. Saldana, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/607,613

(22) Filed: Jun. 27, 2003

(51) Int. Cl.
*B24B 1/00* (2006.01)

(52) U.S. Cl. ..... 451/41; 451/330

(58) Field of Classification Search ..... 451/41, 451/285–287, 330
See application file for complete search history.

(56) References Cited

U.S. PATENT DOCUMENTS 4,606,151 A 8/1986 Heynacher
4,850,152 A 7/1989 Heynacher et al.
5,558,568 A 9/1996 Talieh et al.
5,575,707 A 11/1996 Talieh et al.
5,593,344 A 1/1997 Weldon et al.
5,662,518 A 9/1997 James et al.
5,692,947 A 12/1997 Talieh et al.
5,722,877 A 3/1998 Meyer et al.
5,762,536 A 6/1998 Jairath et al.
5,762,546 A 6/1998 James et al.
5,800,248 A 9/1998 Pant et al.
5,888,120 A 3/1999 Doran
5,888,126 A 3/1999 Hirose et al.
5,916,012 A 6/1999 Pant et al.
5,931,719 A * 8/1999 Nagahara et al. ..... 451/41
5,961,372 A 10/1999 Shendon
5,980,368 A 11/1999 Chang et al.
6,062,959 A 5/2000 Weldon et al.
6,086,456 A 7/2000 Weldon et al.
6,102,786 A 8/2000 Hirose et al.
6,103,628 A 8/2000 Talieh
6,126,527 A 10/2000 Kao et al.
6,135,858 A * 10/2000 Takahashi ..... 451/41
6,135,859 A 10/2000 Tietz
6,155,915 A 12/2000 Raeder
6,234,878 B1 5/2001 Moore
6,277,009 B1 * 8/2001 Chen et al. ..... 451/288
6,328,642 B1 12/2001 Pant et al.
6,336,845 B1 1/2002 Engdahl et al.
6,358,118 B1 3/2002 Boehm et al.
6,607,425 B1 * 8/2003 Kistler et al. ..... 451/41
6,656,024 B1 * 12/2003 Boyd et al. ..... 451/41
6,712,679 B1 * 3/2004 Taylor et al. ..... 451/303
6,729,945 B1 5/2004 Xu et al.
6,790,128 B1 * 9/2004 Taylor et al. ..... 451/41
2004/0224615 A1 * 11/2004 Chen et al. ..... 451/41
2005/0037692 A1 * 2/2005 Taylor et al. ..... 451/41

FOREIGN PATENT DOCUMENTS

CN 1500028 A 5/2004

(Continued)

*Primary Examiner*—M Rachuba
(74) *Attorney, Agent, or Firm*—Martine Penilla & Gencarella, LLP

(57) ABSTRACT

A platen is provided for use in a chemical mechanical planarization (CMP) system. The platen is provided with diaphragms that overcome a fluid-conservation problem experienced in prior air-bearing platens. The diaphragms enable a removal profile to be manipulated by configuring one or more diaphragms to control localized polishing pressure while capturing free-flowing fluid that is input to the apparatus. The diaphragms also minimize loss of normally-free-flowing fluid from a fluid-bearing.

20 Claims, 13 Drawing Sheets

FOREIGN PATENT DOCUMENTS

| | | |
|---|---|---|
| EP | 0706857 | 4/1996 |
| EP | 0881039 | 12/1998 |
| EP | 0914906 A2 | 5/1999 |
| EP | 0920956 | 6/1999 |
| FR | 2767735 | 8/1998 |
| JP | 03259520 | 11/1991 |
| WO | WO0025982 | 5/2000 |
| WO | WO02078904 | 11/2002 |

* cited by examiner

PLATEN WITH DIAPHRAGM AND METHOD FOR OPTIMIZING WAFER POLISHING

BACKGROUND OF THE INVENTION

1. Field of the Invention

This invention relates generally to chemical mechanical planarization, and more particularly to methods of and apparatus for optimizing chemical mechanical planarization processes by manipulating a removal profile using one or more diaphragms configured to control localized polishing pressure while capturing free-flowing fluid that is input to the apparatus, wherein the diaphragms also minimize loss of normally-free-flowing fluid from a fluid-bearing.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional integrated circuit devices. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to variations in the surface topography. In other applications, metallization line patterns are formed in the dielectric material, and then metal CMP operations are performed to remove excess material.

A chemical mechanical planarization (CMP) system is typically utilized to polish a wafer as described above. A CMP system typically includes system components for handling and polishing the surface of a wafer. Such components can be, for example, a rotary polishing pad, an orbital polishing pad, or a linear belt polishing pad. The pad itself is typically made of a polyurethane material or polyurethane in conjunction with other materials such as, for example, a stainless steel belt. In operation, the linear belt polishing pad is put in motion and then a slurry material is applied and spread over the surface of the linear belt polishing pad. Once the linear belt polishing pad having slurry on it is moving at a desired rate, the wafer is lowered onto the surface of the linear belt polishing pad. In this manner, the wafer surface is to be planarized substantially. The wafer may then be cleaned in a wafer cleaning system.

FIG. 1A shows a prior linear polishing apparatus 10 which is typically utilized in a CMP system. The linear polishing apparatus 10 removes materials from a surface of a wafer 12, such as a semiconductor wafer. The material being removed may be a substrate material of the wafer 12 or one or more layers formed on the wafer. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 12 to planarize a surface layer of the wafer.

The linear polishing apparatus 10 utilizes a linear belt polishing pad 14, which moves linearly with respect to the surface of the wafer 12. The surface of the wafer 12 is exposed to the linear belt polishing pad 14. The linear belt polishing pad 14 is a continuous belt mounted on rollers (or spindles) 16 that are typically driven by a motor to provide linear motion 18. A wafer carrier 20 holds the wafer 12 with the surface exposed to a polishing surface 19 of the linear belt polishing pad 14. The wafer 12 is typically held in position by a mechanical retaining ring and/or by vacuum. The wafer carrier 20 positions the wafer 12 relative to the linear belt polishing pad 14 so that the exposed surface of the wafer 12 is forced into contact with the polishing surface 19 of the linear belt polishing pad 14.

FIG. 1B shows a side view of the linear polishing apparatus 10, illustrating the wafer carrier 20 forcing the wafer 12 into contact with the polishing surface 19 of the linear belt polishing pad 14. The linear belt polishing pad 14 may be a continuous belt typically made up of a polymer material such as, for example, the IC 1000 made by Rodel, Inc. layered upon a supporting layer. As the rollers 16 drive the linear belt polishing pad 14 in the linear motion 18 with respect to the wafer 12, a fluid-bearing platen 22 provides a fluid-bearing 24 to support a section of the linear belt polishing pad 14 under an area 26 at which the wafer 12 contacts the polishing surface 19. The support by the fluid-bearing 24 thus opposes a force by which the wafer 12 is forced into contact with the polishing surface 19 of the linear belt polishing pad 14.

The design of the fluid bearing platen 22 has an effect on wafer surface planarity, which is a goal of CMP operations. In an exemplary prior effort to achieve surface planarity in a polishing apparatus of the type of the linear polishing apparatus 10, an attempt was made to control polishing pressure applied by the fluid-bearing 24. In one example shown in more detail in FIGS. 1C and 1D, the attempt was to apply different pressures to different regions 28 (FIG. 1D) of the linear belt polishing pad 14 under the area 26 of contact between the polishing surface 19 (FIG. 1B) and the exposed surface of the wafer 12. The attempt is more fully described in U.S. patent application Ser. No. 10/186,909 filed Jun. 28, 2002 for Fluid Venting Platen For Optimizing Wafer Polishing, which application is assigned to the assignee of the present application, and such application is hereby incorporated by reference. In such application, the different pressures on the regions 28 were to result in different localized polishing pressures applied to the wafer 12, i.e. at wafer locations that correspond to the regions 28. Each different localized polishing pressures was to result from the pressure on the region 28 causing a change in the shape of the supporting layer of the liner belt polishing pad. For example, FIG. 1D shows such change in shape resulting in compression of the polymer material, which in turn was to apply a different polishing pressure to the wafer 12 at the location corresponding to the region 28. In the example shown in FIGS. 1C and 1D, the platen 22 is provided with holes 30 (FIG. 1C) arranged to define zones. In FIG. 1C the zones 32 are designated 32P and 32B as explained below, and are shown configured as concentric circles, for example.

FIG. 1D is an enlargement of a portion of FIG. 1B, and shows sections of the platen 22, the linear belt polishing pad 14, and the wafer 12. Holes 30B are arranged for the zones 32B primarily to provide the fluid-bearing 24, thus the zones 32B are referred to as fluid-bearing zones. Holes 30P are arranged for the zones 32P to contribute to the fluid-bearing 24, but the holes 30P primarily provide the different pressures to the different regions 28, thus the zones 32P are referred to as fluid-pressure zones. In FIG. 1D, one of the holes 30B of the fluid-bearing zones 32B is shown supplying free-flowing fluid (see arrow 34) to provide a pressure P1 of the fluid-bearing 24. This fluid 34 at the pressure P1 flows against the under surface of the supporting layer opposite to the contact area 26. The fluid-bearing 24 is formed by the fluid 34 at the pressure P1 which flows freely in a bearing gap 36 between the platen 22 and the under surface of the supporting layer of the linear belt polishing pad 14. The fluid 34 at the pressure P1 flows freely through the bearing gap 36 and to and through an exit gap 38 that is spaced from a center CL of the platen 22 (see left side exit gap 38 shown radially outward of both the edge of the wafer 12 and the bearing gap 36). The fluid 34 is described as "free-flowing" because the fluid 34 is not significantly restrained from flow through the gaps 36 and 38. The fluid-bearing 24 at the pressure P1 supports the section of the linear belt polishing pad 14 under the area 26 at which the wafer 12 contacts the polishing surface, and reduces the amount of friction between the linear belt polishing pad 14 and the platen 22. To achieve such support of the linear belt polishing pad 14, a fluid supply (not shown) may provide the fluid 34 at a pressure in a range of from 1 to 70 psi. Dynamic losses reduce such supply pressure to provide the fluid-bearing pressure P1 in a range of from 0.5 to 10 psi. Because the fluid 34 is free-flowing, the pressure P1 is referred to as a dynamic pressure. In one example, depending on the diameter of the wafer 12, the fluid 34 may be at the dynamic pressure P1 and be supplied at a volume of about 10 standard cubic feet per second (scfm) for the fluid-bearing zone 32B.

In this example shown in FIG. 1D, the different pressures to be applied to different regions 28 of the linear belt polishing pad 12, and the resulting different polishing pressures, are provided as follows. Those holes 30P that define the particular fluid-pressure zones 32P are also supplied with the fluid 34 from the supply (not shown). These supply pressures are substantially greater than the supply pressures that provide the pressures P1 of the fluid 34 in the zones 32B. The fluid 34 supplied at the greater supply pressure also flows freely from the holes 30P for the zone 32P and against the region 28. This region 28 corresponds to the fluid-pressure zone 32P of the platen 22. Because of the greater supply pressures at which the fluid 34 of the fluid-pressure zone 32P is supplied, dynamic pressures P2 on this region 28 are higher than the fluid-bearing pressure P1. As a result, this region 28 is deformed more than the remainder of the linear belt polishing pad 14 that is deformed in response to the fluid 34 supplied at the fluid-bearing pressures P1. Thus, in response to the fluid 34 at the different pressures P2 at different regions 28 of the supporting layer of the linear belt polishing pad 14, the shape of the supporting layer of the linear belt polishing pad 14 is deformed at locations corresponding to the different regions 28. In turn, the deformed supporting layer compresses the exemplary polymer material on the supporting layer (or permits such material to expand). The compressed or expanded polymer material in turn respectively applies more or less polishing pressure on the exposed surface of the wafer 12 at a wafer region corresponding to the region 28 against which the fluid 34 of the fluid-pressure zone 32P flows.

After flowing against such region 28, the free-flowing fluid 34 of the fluid-pressure zone 32P then freely flows (via the exit gap 38) out of the platen 22 with the freely-flowing fluid-bearing fluid 34 that is at the pressure P1. At the exemplary pressures P2 of the free-flowing fluid 34 of the respective fluid-pressure zones 32P (which are typically adjacent to the edge of an exemplary 300 mm wafer), the volume of the fluid 34 for the fluid-pressure zones 34 may be about 60 scfm, and as described above, is primarily for deformation of the supporting layer of the linear belt polishing pad 14. Thus, the prior linear polishing apparatus 10 requires a fluid supply capable of providing about 70 scfm of the fluid, of which 10 scfm provides the fluid-bearing 24 and 60 scfm is used to obtain the pressures P2 for deforming the supporting layer and the exemplary polymer material of the prior apparatus 10. Since the free-flowing fluid 34 flows through the bearing gap 36 and out the exit gap 38 in this exemplary fluid-bearing 24, and such free-flow is for such fluid-bearing and deformation purposes, the free-flowing fluid 34 must be supplied continuously to establish the exemplary pressures P1 and P2, and at the exemplary 70 scfm volume, which consumes substantial pump energy. Additionally, as the value of the fluid-bearing gap 36 increases, it is necessary to increase the volume of free-flowing fluid 34 that must be supplied through the holes 30, which consumes still more energy for an equivalent deformation of the linear belt polishing pad 14.

As explained above, such prior platens 22 are configured so as to freely-flow the fluid 34 from the holes 30B of the platens 22 to form the fluid-bearing 24 and to freely-flow the fluid 34 from the fluid-bearing 24 to and through the exit gap 38. With such prior platens 22 which rely on use of the fluid 34 at the substantially greater pressures P2, desired final profiles of finished wafers typically cannot be attained when (1) unpolished wafers 12 have a wide range of initial wafer thickness profiles, or there are significant undesired CMP process characteristics, and (2) there is also a requirement to offset such characteristics while minimizing the amount of fluid 34 used to provide the fluid-bearing 24 and to provide such deformation of the linear belt polishing pad 14. Thus, despite the prior arrangement of the platen holes 30P into the fluid-pressure zones 32P to provide selected pressure for such deformation of the linear belt polishing pad 14, there remains an unsolved problem of how to offset such characteristics while minimizing the total amount of fluid 34 used for providing the fluid-bearing 24 and providing such deformation of the linear belt polishing pad 14. This problem is referred to below as the "fluid-conservation problem."

In view of the foregoing, there is a continuing need for ways to overcome the above-described fluid-conservation problem by controlling localized polishing pressure without using free-flowing fluid, and by minimizing the loss of the free-flowing fluid from a fluid-bearing.

SUMMARY OF THE INVENTION

Broadly speaking, embodiments of the present invention fill these needs and overcome the fluid-conservation problem by manipulating a removal profile using one or more diaphragms configured to control localized polishing pressure while capturing free-flowing fluid that is input to the apparatus, wherein the diaphragms also minimize loss of normally-free-flowing fluid from a fluid-bearing. These needs are filled by a single operation that limits the leakage of the fluid from the fluid-bearing and controls localized polishing pressure applied to the different regions of the area of contact between the polishing surface of a linear belt polishing pad and an exposed surface of the wafer. Such single operation controls localized polishing pressure without allowing the prior free-flowing localized polishing pressure fluid input to the apparatus to continue to flow-freely, and by minimizing the loss of free-flowing fluid from a fluid-bearing. It should be appreciated that the present invention can be implemented in numerous ways, including as a process, an apparatus, a system, a device, or a method. Several inventive embodiments of the present invention are described below.

In one embodiment, a platen is provided for use in a chemical mechanical planarization system. A structure is configured with at least one aperture for defining at least one localized fluid pressure platen zone. At least one membrane covers the at least one aperture to prevent fluid of the at least one localized fluid pressure platen zone from exiting the structure. In this embodiment, the at least one membrane is configured with a first section secured to the structure around the at least one aperture. Also, the membrane is configured with a second section surrounded by the first section. The second section is flexible for movement relative to the at least one aperture in response to the fluid of the at least one localized fluid pressure platen zone.

In another embodiment, a platen is provided for use in a CMP system. At least one fluid-bearing zone is provided having a plurality of fluid-bearing outlets to provide fluid-bearing fluid at a first, or fluid-bearing, pressure in a fluid-bearing. The at least one fluid-bearing zone is disposed below, and is capable of providing the fluid-bearing pressure to, a polishing pad. At least one fluid pressure zone includes at least one fluid pressure port for transferring fluid-pressure fluid relative to the at least one fluid-bearing zone and the polishing pad. The at least one fluid pressure zone is disposed below the polishing pad. The at least one fluid pressure zone also includes a member configured to define a flexible pocket covering the at least one fluid pressure port to prevent the fluid-pressure fluid from freely-flowing relative to the at least one fluid-bearing zone. The fluid-pressure fluid transferred by the at least one fluid pressure port flexes the flexible pocket to configure the flexible member so that the polishing pad achieves a particular polishing profile during a CMP operation. Also, a value of fluid pressure of the fluid-pressure fluid in the flexible pocket is a static pressure value that may be varied relative to a value of the first pressure. Also, the fluid-bearing fluid at the first pressure has a tendency to freely-flow from the at least one fluid-bearing platen zone and out of the platen. The flexure of the flexible pocket in response to the fluid-pressure fluid transferred by the at least one fluid pressure port configures the flexible pocket so that the pocket restricts the tendency of the fluid-bearing fluid supplied at the first pressure to freely-flow.

In yet another embodiment, a platen is provided for use in a CMP system in which a polishing pad is configurable to apply selected polishing pressures to different areas of a wafer to be planarized. The platen may include a fluid-bearing structure configured with a first plurality of apertures for transferring polishing pressure control fluid. The apertures of the first plurality are configured to define a plurality of localized fluid pressure platen zones for applying selectable polishing pressure control pressures to the polishing pad. A membrane is provided corresponding to each localized fluid pressure platen zone. Each membrane covers respective ones of the apertures corresponding to a respective one of the localized fluid pressure platen zones. Each membrane is sealed to the fluid-bearing structure to separate the polishing pressure control fluid of the respective localized fluid pressure platen zone from the fluid-bearing structure. The fluid-bearing structure may be further configured with a second plurality of apertures for supplying fluid-bearing fluid. The second plurality of apertures is configured to define a second plurality of localized fluid-bearing platen zones for supporting the polishing pad. The fluid-bearing structure is further configured with a gap that is normally open to permit relatively free-flow of the fluid-bearing fluid to exit the fluid-bearing structure. Each of the membranes is sealed to the fluid-bearing structure along the gap and responds to the polishing pressure control fluid from one or more of the apertures of the respective first plurality of apertures to restrict the gap and limit the flow of the fluid-bearing fluid from the fluid-bearing structure. The restriction is provided when each sealed membrane responds to the polishing pressure control fluid by becoming inflated to define a pocket that extends at least partially across the gap, limiting the flow of the fluid-bearing fluid from the fluid-bearing structure. The sealing of each membrane enables different selectable localized fluid pressures to be applied to each localized fluid pressure platen zone to provide differential polishing pressure control pressures to the polishing pad.

In a further embodiment, a method is provided for limiting consumption of fluid in a platen of a CMP system. Operations of the method may include providing the platen with at least one aperture for defining at least one localized fluid pressure platen zone. Also, an operation seals the at least one aperture with a flexible membrane secured around the at least one aperture to prevent fluid of the at least one localized fluid pressure platen zone from exiting the platen. The platen may define a first gap between a polishing pad and the platen. The method may further include an operation of transferring the fluid of the at least one localized fluid pressure platen zone relative to the at least one aperture to cause the membrane to flex. The transferring operation is controlled to control a localized planarization pressure applied via the polishing pad to a workpiece such as a wafer. The flexed membrane enters the first gap. In another aspect of the method, the first gap may extend outwardly from a central platen zone to the at least one localized fluid pressure platen zone. Further operations may include configuring the platen with a plurality of apertures of the at least one aperture for defining the at least one localized fluid pressure platen zone outwardly of the central platen zone. The fluid of the at least one localized fluid pressure platen zone is transferred relative to each of the plurality of apertures to cause flexure of the respective membrane that seals the respective aperture. Control of the transferring operation causes the respective flexed membranes to control a localized fluid pressure applied to the polishing pad. Resulting respective localized planarization pressures are applied via the polishing pad to the wafer. In this manner, the flexed membranes enter the first gap and form an exit gap that is narrower than the first gap.

Because of the advantageous effects of the present invention, the fluid-conservation problem described above is overcome. Specifically, sealing of the at least one aperture with the flexible membrane secured around the at least one aperture advantageously prevents fluid of the at least one localized fluid pressure platen zone from exiting the fluid-bearing platen. The sealing results in static, not dynamic, pressure in the pockets of the membranes, so that the platen and method of the present invention overcome one aspect of the fluid-conservation problem described above while providing the localized fluid pressure applied to the polishing pad. The localized fluid pressure results in respective localized planarization pressures being applied via the polishing pad to the wafer. More specifically, configuring the flexed membrane to enter the fluid-bearing gap and form the narrower exit gap advantageously restricts the amount of fluid-bearing fluid that can exit the fluid-bearing platen through the fluid-bearing gap. Thus, the present invention overcomes another aspect of the fluid-conservation problem described above while retaining the fluid-bearing function. Consequently, the present platen and method may not only control polishing of various portions of the wafer, but also may use significantly less fluid than prior art platens. Therefore, the platen and method described herein increase wafer production efficiency and decrease wafer production costs.

Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

Figure 1A:
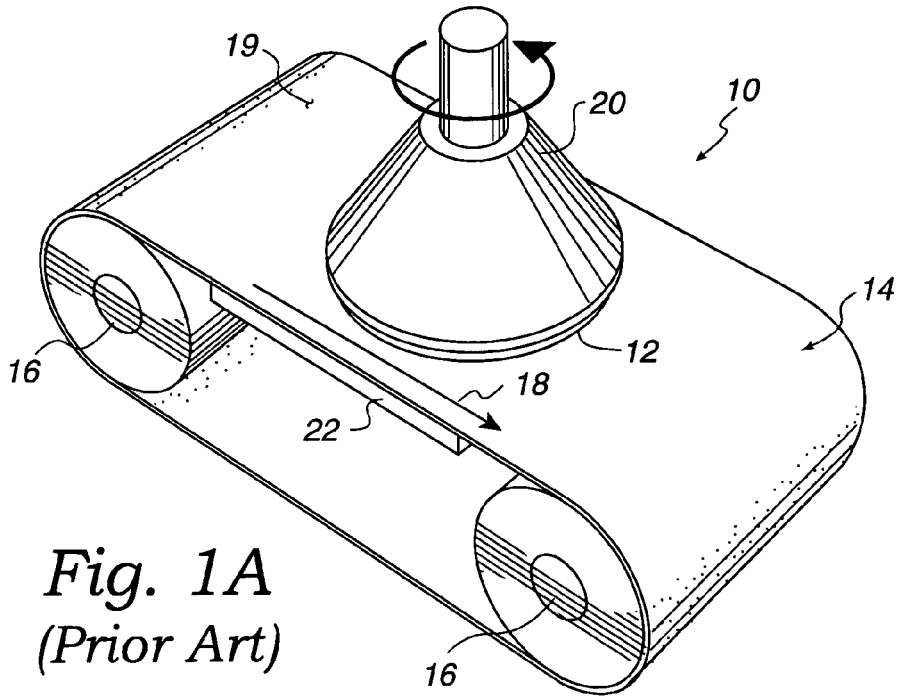
Fig. 1A (Prior Art)
FIG. 1A shows a linear polishing apparatus which is typically utilized in a prior CMP apparatus.
Figure 1B:
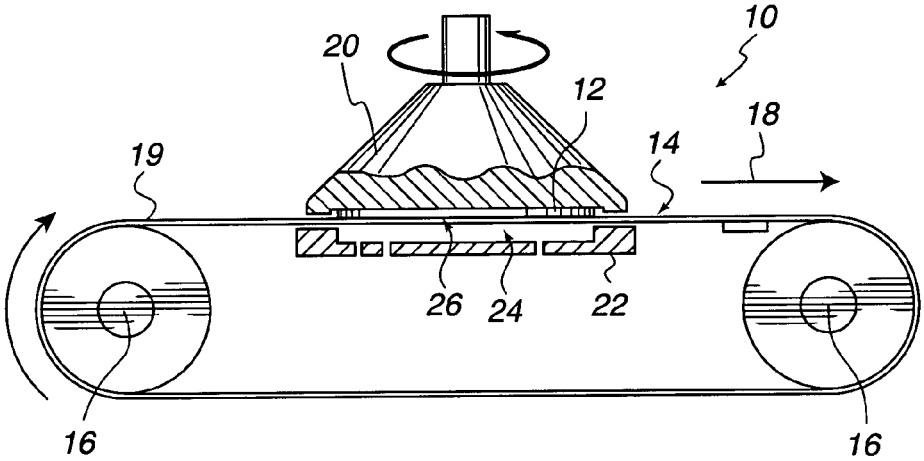
Fig. 1B (Prior Art)
FIG. 1B shows a side view of the prior linear polishing apparatus.
Figure 1C:
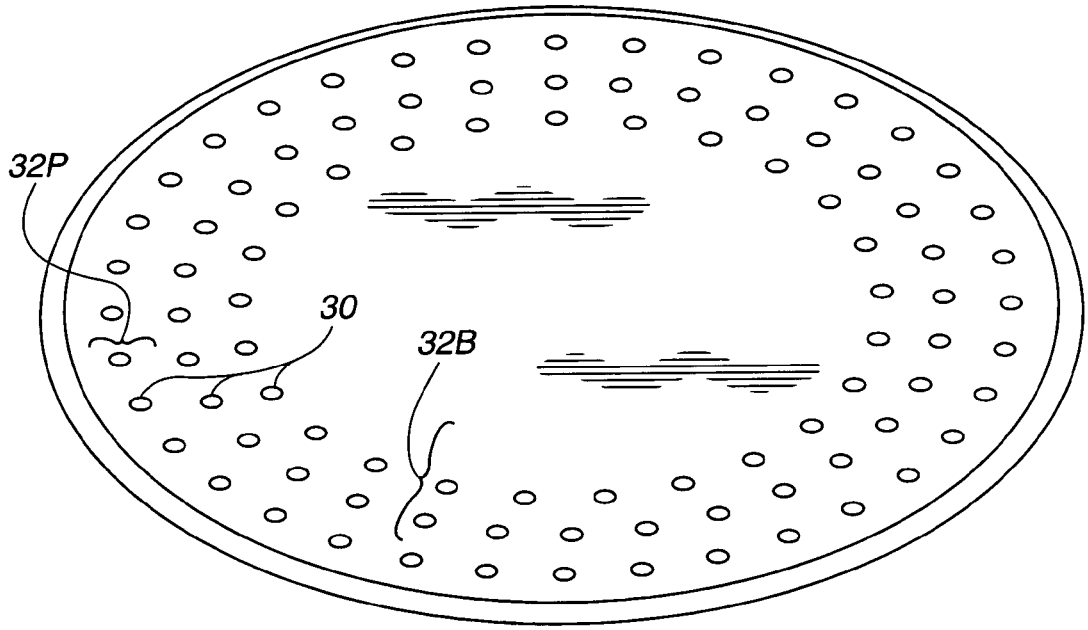
Fig. 1C (Prior Art)
FIG. 1C shows the prior linear polishing apparatus with holes arranged to define zones to polish non-uniform oxide deposition on a wafer.
Figure 1D:
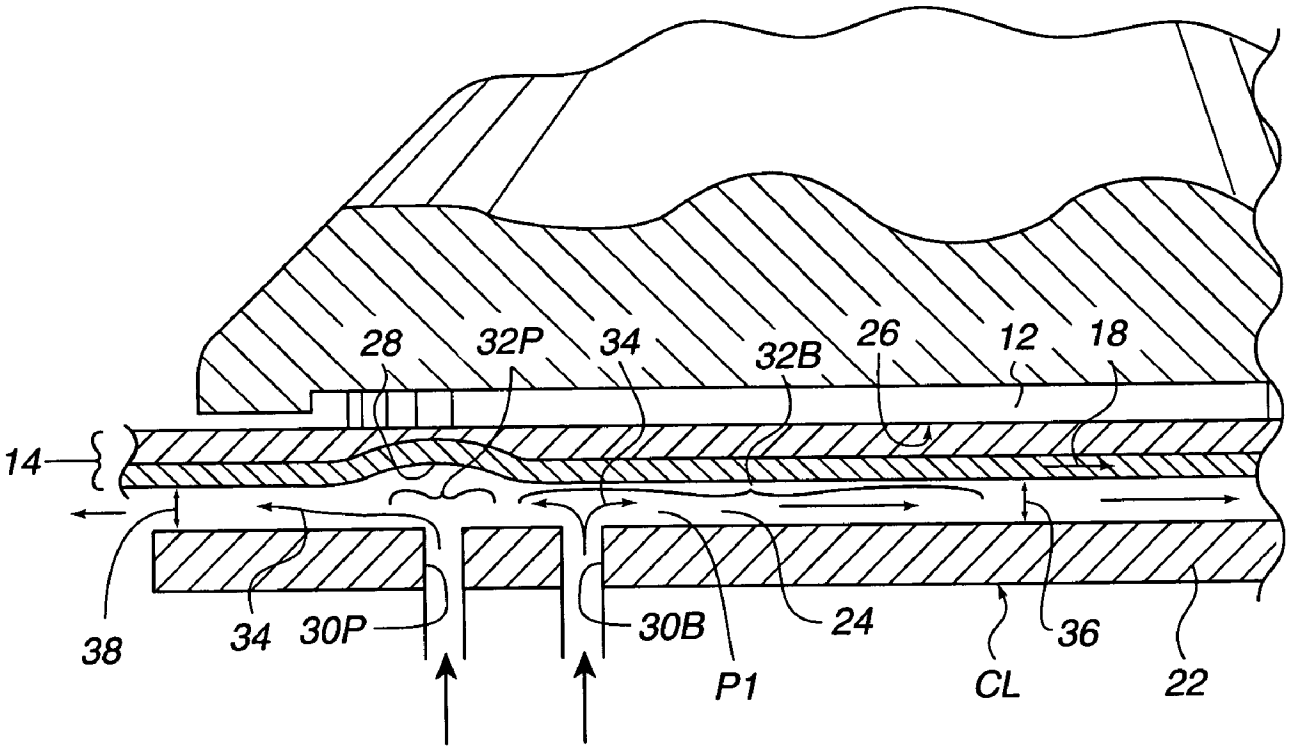
Fig. 1D (Prior Art)
FIG. 1D shows the holes admitting fluid for a fluid-bearing which flows freely out of the apparatus.

An invention is disclosed for a platen that provides control, or adjustment or manipulation, of a removal profile, which is also known as a polishing profile or desired removal profile, during a CMP process. A profile is the cross-sectional contour of an exposed surface of a wafer. An initial profile is the profile of the wafer before planarization, e.g., before performing the CMP process. The removal profile is the profile which is to be removed during the CMP process to result in a desired final profile, i.e., the desired profile of the wafer upon completion of the CMP process. Ideally, removal of the removal profile from the initial profile results in the desired final profile. The removal profile thus defines the locations and amounts of materials to be removed from certain regions of the surface of the wafer. For CMP processing, the platen of the present invention controls (or adjusts or manipulates) the removal profile using one or more diaphragms, also known as flexible members or membranes. Such control may take into account characteristics of a CMP process, such as a higher removal rate at a leading edge of a wafer than at a trailing edge of the wafer. Also taken into account may be the initial profile of the wafer as compared to the desired final profile. In the operation of the platen, the configurations of the membranes are modified (or varied) to control localized polishing pressure, which is polishing pressure applied to specific (or local) regions of the wafer. The various localized polishing pressures in turn have an effect on the removal profile. The modifying of the configurations of the membranes is effected by urging fluid-pressure fluid relative to the platen. The membranes capture the otherwise free-flowing fluid-pressure fluid as the configurations of the membranes are controlled by the fluid-pressure fluid. The modified configurations of the membranes also minimize loss of normally-free-flowing fluid from a fluid-bearing, also known as an air-bearing. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to obscure the present invention.

In general, embodiments of the present invention provide a platen within a CMP apparatus that has the unique ability to overcome the fluid-conservation problem described above. As also described above, the control of the removal profile includes taking into account the characteristics of the CMP process, while providing both a fluid-bearing between a polishing pad and the platen, and control of polishing pressure at the local regions of the wafer. The platen may independently increase and/or decrease polishing pressure on nearly any region of the wafer, enabling the removal profile to be better controlled thus leading to optimized wafer processing operations. Significant in overcoming the fluid-conservation problem, the optimized wafer processing operations include both (1) capturing the otherwise free-flowing fluid-pressure fluid that is input to control the removal profile, and (2) minimizing the loss of normally-free-flowing fluid-bearing fluid from the fluid-bearing. As a result, the present invention may offset the CMP process characteristics and may account for non-uniform deposition of substances on wafers by adjusting the removal profile according to the differing pre-CMP processing thicknesses at different regions of the wafer to achieve a desired removal profile. Thus, the present invention captures the otherwise free-flowing fluid-pressure fluid and minimizes the loss of normally-free-flowing fluid from the fluid-bearing to further optimize the CMP processing operations.

Operation of a platen of the embodiments of the present invention may result in forming any suitable number of configurations of localized fluid-pressure zones (also known as high fluid-pressure zones and low-fluid pressure zones) and/or at least one fluid-bearing zone, which are known collectively as "operational zones". Each different operational zone corresponds to a platen zone that includes a plurality of holes (also known as apertures, ports, or outlets). Depending on the function to be provided, a platen zone may be utilized to provide fluid at different types and values of pressure. One such function is offsetting the CMP process characteristics, another is providing a fluid-bearing for supporting a polishing pad spaced from the platen during the CMP operations. One or more fluid-bearing platen zones perform such supporting by providing the fluid (which for this function is referred to as "fluid-bearing fluid") at different pressures P1 via the holes of the fluid-bearing platen zone. The fluid-bearing fluid of the fluid-bearing platen zones also contributes to another function, which is general control of the removal profile according to the differing pre-CMP processing thicknesses in different regions of the wafer and the desired final profile of the wafer upon completion of the CMP process.

Other platen zones, known as localized fluid-pressure platen zones, also separately perform the control, manipulating or adjusting of the removal profile. The control is by providing fluid at different pressures. The fluid for this function is known as "fluid-pressure fluid", and may be at different pressures P2 for specific (or localized) holes of the localized fluid-pressure platen zones.

The fluid-bearing platen zones and the localized fluid-pressure platen zones cooperate to provide specific control of the removal profile. Such control may be according to the CMP process characteristics, differing pre-CMP processing thicknesses in different regions of the wafer, and the desired final profile of the wafer upon completion of the CMP process. The controlled removal profile is used during a CMP process to obtain the desired final profile of the wafer.

It should be appreciated that any suitable type of substance may be planarized using the platen described herein. It should also be understood that the embodiments of the present invention can be utilized for polishing any size wafer such as, for example, 200 mm wafers, 300 mm wafers, etc. Therefore, the platen described herein may be any suitable size depending on the application desired.

A fluid as utilized herein for the fluid-bearing may be any type of gas (e.g. clean dry air) or liquid (e.g. water). Preferably, clean dry air (referred to herein simply as "air") is utilized as the fluid. Therefore, the platens described below may include fluid-bearings that utilize gas or liquid to control pressure applied by a polishing pad to a wafer.

Figure 2:
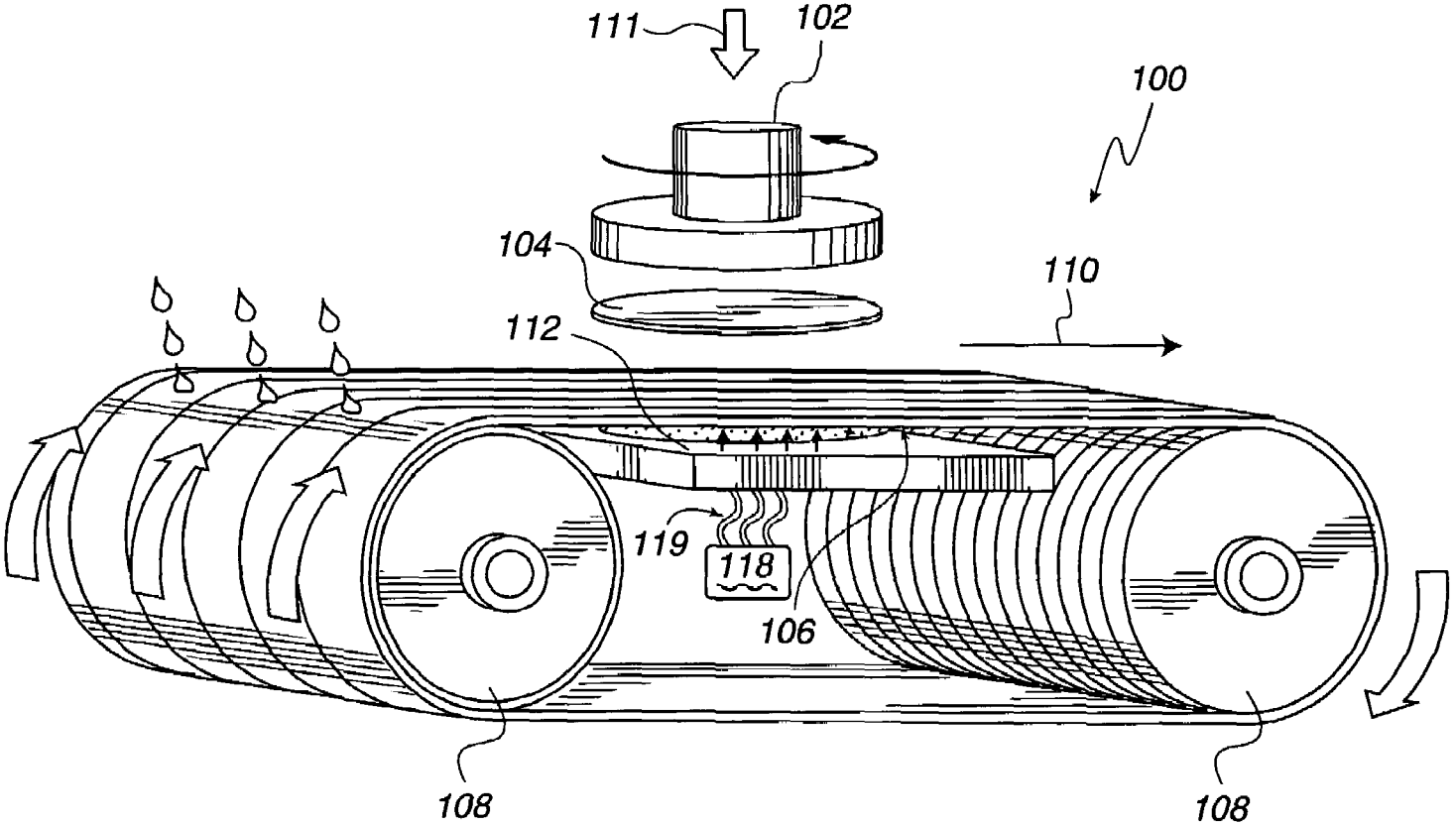
FIG. 2 shows a side view of a wafer linear polishing apparatus in accordance with one embodiment of the present invention.

FIG. 2 shows a side view of a wafer linear polishing apparatus 100 in accordance with one embodiment of the present invention. In this embodiment, a carrier head 102 may be used to secure and hold a wafer 104 in place during processing. A polishing pad 106 preferably forms a continuous loop around rotating drums 108. The polishing pad 106 may be similar to the prior linear belt polishing pad 14 described above. Thus, the polishing pad 106 may, for example, include a polymer (or top) material layered upon a supporting (or lower) layer. The polishing pad 106 generally moves in a direction 110 at a speed of about 400 feet per minute, however, this speed may vary depending upon the specific CMP operation. As the polishing pad 106 moves linearly, the carrier head 102 may rotate and lower the rotating wafer 104 onto a top surface of the polishing pad 106. The lowering causes an exposed surface of the wafer 104 to apply a force (see arrow 111) against the top surface of the polishing pad 106. As described below, the force 111 is resisted by the polishing pad 106, resulting in a polishing pressure being applied to the exposed surface of the wafer 104.

Figure 3A:
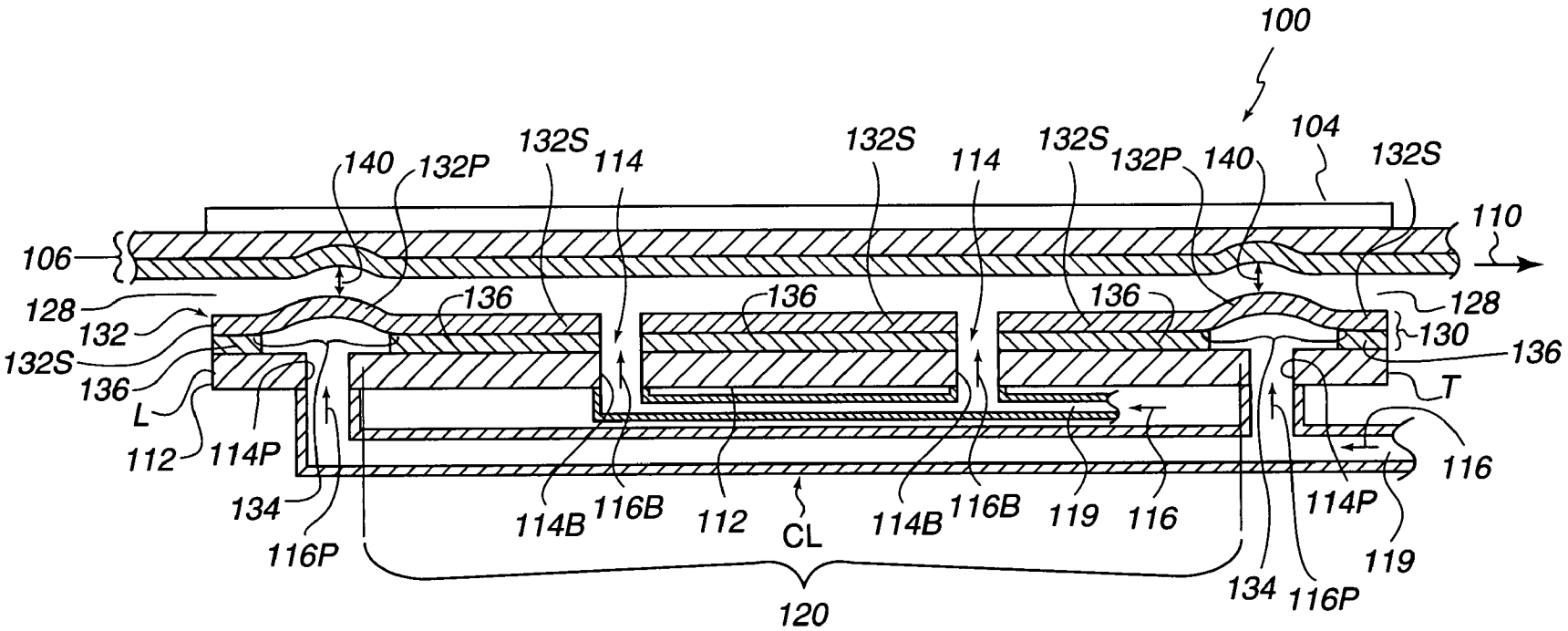
FIG. 3A shows a platen of the present invention configured for both supporting a polishing pad and adjusting a removal profile according to differing pre-CMP processing thicknesses at different regions of a wafer.
Figure 3B:
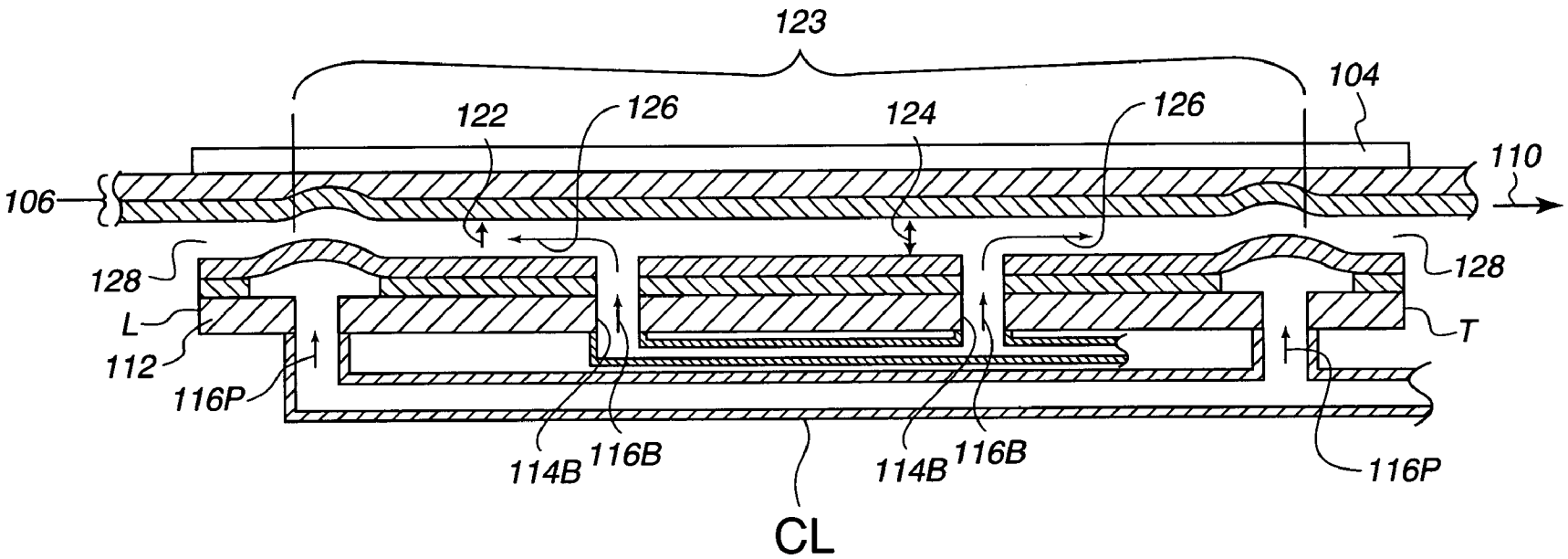
FIG. 3B shows the platen of FIG. 3A with a fluid-bearing zone.

FIGS. 2, 3A and 3B show a platen 112 (also known as a structure or a fluid-bearing structure) configured for both supporting the polishing pad 106 and controlling the removal profile for the CMP process according to the CMP process characteristics, differing pre-CMP processing thicknesses in different regions of the wafer, and the desired final profile of the wafer upon completion of the CMP process. For clarity of illustration, the cross sectional view of FIG. 3A shows structural details of only a portion of the platen 112, and FIG. 3B shows details of the operation of the portion of the platen 112. Referring to FIG. 3A, a plurality of holes (or apertures, ports, or outlets, collectively referred to by the reference number 114) is shown extending through the platen 112 from a top surface to a bottom surface of the platen. The platen 112 may utilize any type of fluid (see arrows 116), such as the above-described liquid or gas. One such fluid 116 is referred to as fluid-bearing fluid 116B. The fluid-bearing fluid 116B is input from a source 118 (FIG. 2) via a manifold 119 (FIG. 2). The source 118 is controllable to provide the fluid-bearing fluid 116B at a desired supply pressure and volume. Typical supply pressure may be in the range of from about 1 to 70 psi, which is a range of dynamic pressure. Typical supply volume may be about 15 scfm, which is somewhat more that the prior supply volume of about 10 sfcm. The fluid-bearing fluid 116B from the source 118 is input to certain ones of the holes 114 (referred to as the holes 114B). The holes 114B define a fluid-bearing platen zone (see bracket 120, FIG. 3A), described below. The fluid-bearing fluid 116B is at a pressure P1. The source 118 is controlled so that the pressure P1 may be in a range of from about 0.5 to about 10 psi. The fluid-bearing fluid 116B is output from the holes 114B of the fluid-bearing platen zone 120 to provide the pressure P1 above the platen 112. The pressure P1 exerts an upward force (see arrow 122, FIG. 3B) on the area of an underside of the polishing pad 106. The force 122 is in opposition to the force 111 (FIG. 2). The force 122 assists in controlling the polishing pad profile and also primarily provides the fluid-bearing to support the polishing pad 106 during the CMP process. A minimum pressure P1 above the platen 112 provides the fluid-bearing and a fluid-bearing gap 124 (FIG. 3B) between the underside of the polishing pad 106 and the platen 112. The minimum pressure P1 may be provided by applying a supply pressure in a range of about 1 to 70 psi, for example.

A pressure P1 may not only assist in providing the fluid-bearing and the fluid-bearing gap 124, but may be selected to also increase or decrease the amount of the force 122 on a region of the area of the underside of the polishing pad 106 opposite to the particular hole 114B to assist in controlling a polishing profile of the polishing pad 106. Such control is by changing how the polishing pad 106 is deformed opposite to the particular hole 114B in response to the increased force 122. For example, a change in the deformation may result in applying more or less polishing pressure against that region of the exposed surface of the wafer. Such control of the polishing profile is used in assisting in control of the removal profile described above.

As described above, the holes 114B define the fluid-bearing platen zone 120. The lateral extent of the bracket 120 (FIG. 3A) indicates a lateral extent of the fluid-bearing platen zone 120 relative to a center (see CL) of the platen 112. Also, as described below the plurality of the holes 114B may be arranged to form a plurality of the fluid-bearing platen zones 120, each of which supplies the fluid-bearing fluid 116B to provide the fluid-bearing at the first pressure P1, for example. At least one fluid-bearing platen zone 120 is provided by the arrangement of the holes 114B.

The lateral extent and arrangement of the holes 114B of the fluid-bearing platen zone 120, and (referring to FIG. 3B) of the fluid-bearing fluid 116B emitted from the holes 114B, result in the formation of a fluid-bearing zone (see bracket 123) in the fluid-bearing gap 124 that extends between the platen 112 and the underside of the polishing pad 106. Arrows 126 in FIG. 3B indicate that the fluid-bearing fluid 116B flows to the left and right through the fluid-bearing gap 124. A value of the fluid-bearing gap 124 corresponds to the thickness of a layer of the fluid-bearing fluid 116B flowing in the fluid-bearing zone 123. As described above, it may be appreciated that in prior fluid-bearings, the fluid-bearing fluid 116B normally flows freely in the fluid-bearing gap 124. That is, without the structure of the platen 112 of the present invention, the fluid-bearing fluid 116B would otherwise freely-flow from the platen 112. The free-flow would occur through an exit gap 128 at the outer edge of the platen 112. The exit gap 128 is shown at a leading edge L and a trailing edge T of the platen 112. Therefore, when the fluid-bearing fluid 116B is described as "freely-flowing" or "normally freely-flowing" or "would otherwise freely-flow" in connection with the present invention, such description refers to a tendency of the fluid-bearing fluid 116B to flow in the direction of the arrows 126 in a relatively unrestricted manner into and through the fluid-bearing gap 124 and out the exit gaps 128.

When the platen 112 is made from low friction material, for example, a fluid-bearing may not need to be provided. However, as described above, the prior fluid 34 would in this case still flow freely from the prior holes 30P to control the deformation of the prior regions 28. To restrict the fluid-bearing fluid 116B from freely-flowing (when the fluid-bearing is used), and to avoid the use of the free-flowing fluid 116 in control of the polishing pressure (whether or not the fluid-bearing is used), FIG. 3A also shows the platen 112 of the present invention including at least one hole 114P and a membrane structure 130. When the fluid-bearing is not used, the platen 112 may be referred to as a structure, whereas when the fluid-bearing is used, the platen 112 may be referred to as a fluid-bearing structure. In the cross sectional view of FIG. 3A, the at least one hole 114P is shown as two exemplary holes 114P provided through the top surface of the platen 112 and positioned toward the exit gap 128 relative to the holes 114B. The membrane structure 130 is configured with a membrane 132 covering each of the at least one hole 114P, and is shown covering the two illustrated holes 114P. The holes 114B extend through the membrane 132 to admit the fluid-bearing fluid 116B to the fluid-bearing zone 123. Although FIG. 3A shows the at least one hole 114P as being the exemplary two such holes 114P, it is to be understood that any plurality of holes 114P may be used, as described below.

Via the manifold 119 (FIG. 2), fluid-pressure fluid (see arrows 116P in FIGS. 3A and 3B) is input from the source 118 (FIG. 2) to the holes 114P. In addition to restricting the fluid-bearing fluid 116B from freely-flowing from the exit 128, the membrane structure 130 is configured to prevent the fluid-pressure fluid 116P from exiting the platen 112 in a freely-flowing manner. FIG. 3A shows a plurality of the holes 114P which define at least one localized fluid-pressure platen zone (indicated by brackets 134). The localized fluid-pressure platen zone 134 is configured with an exemplary ring (or annular) shape, such that in the cross section shown in FIG. 3A, two portions of the same localized fluid-pressure platen zone 134 are shown. The ring-shaped localized fluid-pressure platen zone 134 is thus localized in that it extends laterally only a portion of the extent of the fluid-bearing platen zone 120. The brackets 134 indicate the lateral extent of the two portions of the localized fluid-pressure platen zone 134.

The membrane 132 may be configured from polycarbonate sheet, Mylar brand polyurethane, carbon-filled Peek brand sheeting, carbon fiber/Peek brand composite sheeting, or a metal such as stainless steel sheeting, for example. FIG. 3A shows the membrane 132 including a plurality of first sections 132S and a plurality of second sections (also referred to as pockets, or pocket sections) 132P. The first sections 132S are secured to the top surface of the platen 112 by respective fastenings 136. The fastenings may be 3M Company brand "3M 467 MP" or "3M 9690" double coated tape with adhesive when the membrane is polycarbonate sheet, for example. When metal is used for the membrane 132, the fastenings 136 may be formed by brazing or welding, for example. The first sections 132S of the membrane 132 are thus secured around the holes 114P. The plurality of second sections 132P are integral with the first sections 132S and are not fastened (i.e., not secured) to the top surface of the platen 112. The pockets 132P are surrounded by the first sections 132S, and are thus configured to extend over the holes 114P. The pockets 132P are thus sealed in a fluid-tight manner to the platen 112 by the first sections 132S.

Figure 3C:
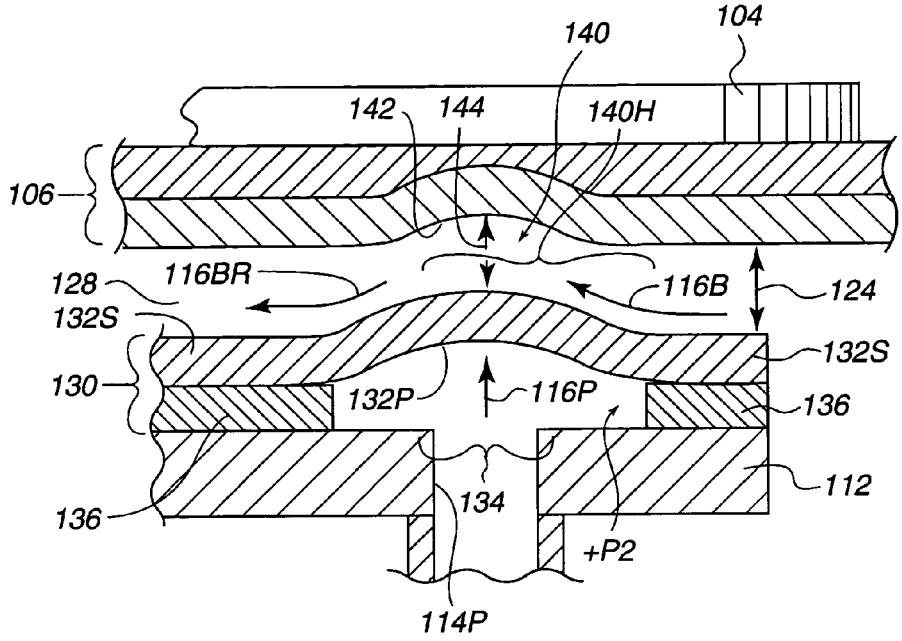
FIGS. 3C and 3D show enlarged portions of FIG. 3A, including one fluid-pressure hole and a membrane structure related to that one hole.
Figure 3D:
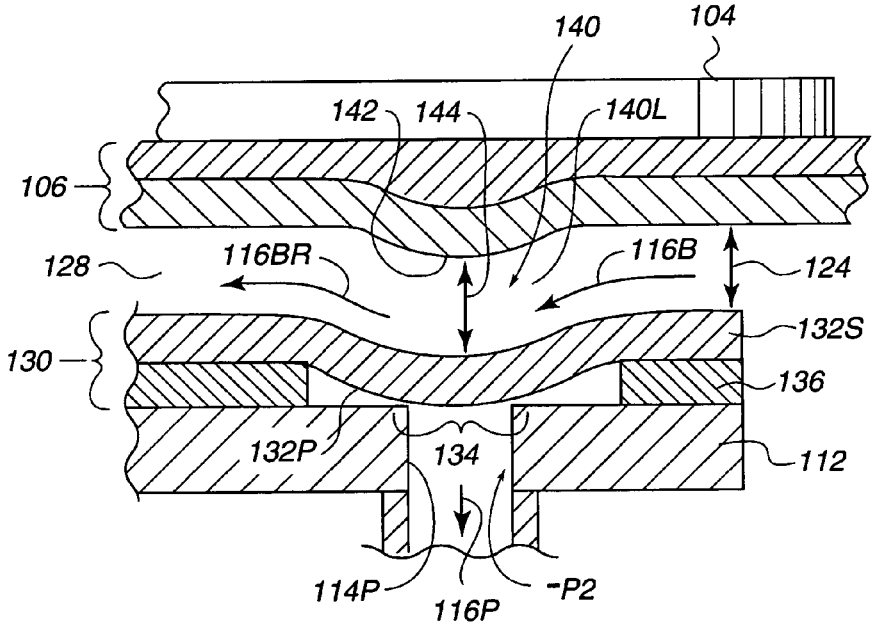

For clarity of illustration, FIGS. 3C and 3D show enlarged portions of FIG. 3A, and include only one of the holes 114P and the membrane structure 130 related to that one hole 114P. The pockets 132P are free to move relative to the respective hole 114P adjacent to the respective first sections 132S. The membranes 132 have a characteristic by which the pockets 132P may expand and contract (e.g., generally in the manner in which a balloon stretches or enlarges under pressure, and contracts when the pressure is reduced, and returns to a deflated shape when the pressure is removed). The expansion and contraction characterize an inflated configuration of the membranes 132 and are relative to the respective hole (or holes) 114P that is covered by the respective pocket 132P. Such expansion and contraction may be controlled by the fluid-pressure fluid 116P which is supplied by the source 118 via the manifolds 119 to the holes 114P. The fluid-pressure fluid 116P is in the pockets 132P at static pressures P2. FIG. 3C shows that one value of the pressure P2 in the pocket 132P expands (or inflates) the pocket 132P so the pocket extends substantially into the fluid-bearing gap 124 opposite to the particular location of the respective hole 114P. The one value of the pressure P2 may be in a range of from about 1 to 2 psi, for example, greater than the value of the pressure P1 of the fluid-bearing in the fluid-bearing gap 124. Such one value of the pressure P2 is sufficient to inflate the pocket 132P in opposition to such pressure P1.

In the exemplary ring-like location shown in FIGS. 3A and 3B (on each side of the center CL), the pocket 132P expands and enters the fluid-bearing gap 124 between the hole 114B and the exit 128. FIG. 3C shows the expanded pocket 132P causing a localized fluid-pressure zone 140 to be a localized high fluid-pressure zone (see bracket 140H) between the pocket 132P and the underside of the polishing pad 106. The lower supporting layer of the polishing pad 106 is deformed by the pressure of the localized high fluid-pressure zone 140H as illustrated by a dimple-like section 142. In turn, the dimple-like section 142 deforms (or compresses or squeezes) the top material of the polishing pad 106. The top material applies a greater polishing pressure on a region of the wafer 104 than is applied to surrounding regions of the wafer 104 that are spaced from the localized high fluid-pressure zone 140H. The deformation (dimple-like section 142) of the lower supporting layer of the polishing pad 106 in response to the expansion of the pocket 132P, and the compression of the top material, result in manipulation of the removal profile. The amount of this deformation and compression of the polishing pad 106 is controlled by controlling the pressure of the fluid 116P supplied by the source 118. This exemplary manipulation results in an increase in the removal of material from the wafer 104 at the region of the wafer corresponding to the deformation, and may be explained in terms of a "stiffness" K of the fluid-bearing. When the pocket 132P expands into the fluid-bearing gap 124, a value of an exit gap 144 opposite to the pocket 132P becomes less than the value of the fluid-bearing gap 124. As a result, the stiffness K of the fluid-bearing is greater at the exit gap 144 than at the fluid-bearing gap 124, resulting in the described deformation and compression of the polishing pad 106, and an increase in the removal of material from the wafer 104 at the region of the wafer corresponding to the deformation. It may also be understood that when the pocket 132P expands into the fluid-bearing gap 124 and the value of a vertical dimension of the exit gap 144 becomes less than the value of a vertical dimension of the fluid-bearing gap 124, the once freely-flowing fluid-bearing fluid 116B will be restricted as the fluid-bearing fluid 116B flows toward the exit gap 128. An arrow 116BR indicates that as a result of this restriction, the flow of the fluid-bearing fluid 116B through the exit gap 144 will be reduced by each of the pockets 132P that expand into the fluid-bearing gap 124.

In contrast to the substantial extension of the pocket 132P into the fluid-bearing gap 124 as shown in FIG. 3A, FIG. 3D shows the response of the pocket 132P to another value of the static pressure P2 in the pocket 132P. This value may, for example, be less than the +P2 value shown in FIG. 3C, so as to have a pressure differential between two exemplary pockets 132P that receive the fluid-pressure fluid 116P at the different pressures P2. The pressure P2 may be a negative static pressure (shown as "−P2"), which may have an exemplary value of minus 100 to 200 millimeters of mercury. In response to this lower value of the static pressure P2, the pocket 132P contracts and returns to a flat configuration, and is then pulled (or expanded) into the respective hole 114P. In the exemplary location shown in FIGS. 3A and 3B, the pocket 132P contracts, and may be somewhat stretched and enters the respective hole 114P between the hole 114B and the exit 128. FIG. 3D shows the contracted pocket 132P causing the lower supporting layer of the polishing pad 106 to be deformed as illustrated by an inverted (or downwardly-extending) shape of the dimple-like section 142 of the polishing pad 106. The top material of the polishing pad 106 stays in contact with the wafer 104 and expands into the inverted dimple-like section 142. In turn, the expanded top material and the inverted dimple-like section 142 of the polishing pad 106 apply less polishing pressure on the region of the wafer 104 that is in contact with the expanded top material. This deformation of the polishing pad 106 in response to the extension of the pocket 132P into the hole 114P, and a resulting decrease in the removal of material from the wafer 104 at the contact region of the wafer 104 corresponding to the deformation, may also be explained in terms of the "stiffness" K of the fluid-bearing. When the pocket 132P is pulled to the flat configuration or enters the hole 114P, the value of the vertical dimension of the exit gap 144 opposite to the pocket 132P increases relative to the value of the vertical dimension of the fluid-bearing gap 124. As a result, the stiffness K of the fluid-bearing is less at the exit gap 144 than at the fluid-bearing gap 124, resulting in a decrease in the removal of material from the wafer at the contact region of the wafer 104.

It may be understood, then, that the platen 112 provides a fluid-bearing structure configured with a first plurality of apertures in the form of the holes 114P for transferring polishing pressure control fluid in the form of the fluid-pressure fluid 116P. Also, the apertures (holes 114P) are configured to define a plurality of the localized fluid pressure zones 140 for applying selectable polishing pressure control pressures to the polishing pad 106. Also, there may be a membrane 132 corresponding to each localized fluid pressure zone 140, and each membrane 132 may cover respective ones of the apertures (holes 114P) corresponding to a respective one of the localized fluid pressure zones 140. Also, each membrane 132 may be being sealed to the fluid-bearing structure of the platen 112 to separate the polishing pressure control fluid (i.e., the fluid-pressure fluid 116P) of the respective localized fluid pressure zone 140 from the fluid-bearing structure. The sealing of each membrane 132 enables different selectable (e.g., positive, negative, or different positive values or different negative values) localized fluid pressures P2 to be applied to each localized fluid pressure platen zone 134 to provide differential polishing pressure control pressures to the polishing pad 106, as more fully described below.

It may also be understood that the pressure P1 and amount of the fluid-bearing fluid 116B in the fluid-bearing may be controlled by controlling the source 118. Similarly, the static pressure P2 of the fluid-pressure fluid 116P in the pockets 132P may be controlled by controlling the source 118. In this manner, there is control of the supply of the fluid 116P via appropriate holes 114P for the localized fluid-pressure platen zones 123. In more detail, in one embodiment, the fluid source 118 may be a regulator managed by a controller. Such a regulator may be used for the fluid-bearing zones 123 that are toward the outside edge of the wafer 104, for example. The fluid source 118 may separately control the pressure of the respective fluid 116B and 116P in each respective fluid-bearing platen zone 120 and fluid-pressure platen zone 134. In one exemplary embodiment, the fluid source 118 may be connected by the respective manifolds 119 to the respective holes 114B or 114P of the platen 112. Each of the manifolds 119 may correspond to a particular one of the fluid-bearing platen zones 120, or a particular fluid-pressure platen zone 123. Therefore, it may be appreciated that there may be any suitable number of manifolds 119 depending on the configuration of the platen 112. Thus, the fluid source 118 may be utilized to provide any suitable respective pressure P1 or P2 to different independently controllable ones of the fluid-bearing platen zones 120 and fluid-pressure platen zones 134 at which the respective holes 114B and 114P are located. In turn, the respective fluid-bearing platen zones 120 and fluid-pressure platen zones 134 will cause formation of the respective fluid-bearing zones 123 (FIG. 3B) and fluid-pressure zones 140 (FIGS. 3C and 3D) as described above. Further, because the fluid 114P is not free-flowing, and is instead captured by the membranes 132, the above-described exemplary 60 scfm free-flow of the prior linear polishing apparatus 10 is avoided. In contrast, in the present invention, once the configuration of a particular pocket 132P is established, there is only the static pressure P2 in the pocket 132P and no free-flow of the fluid 116P.

Figure 4A:
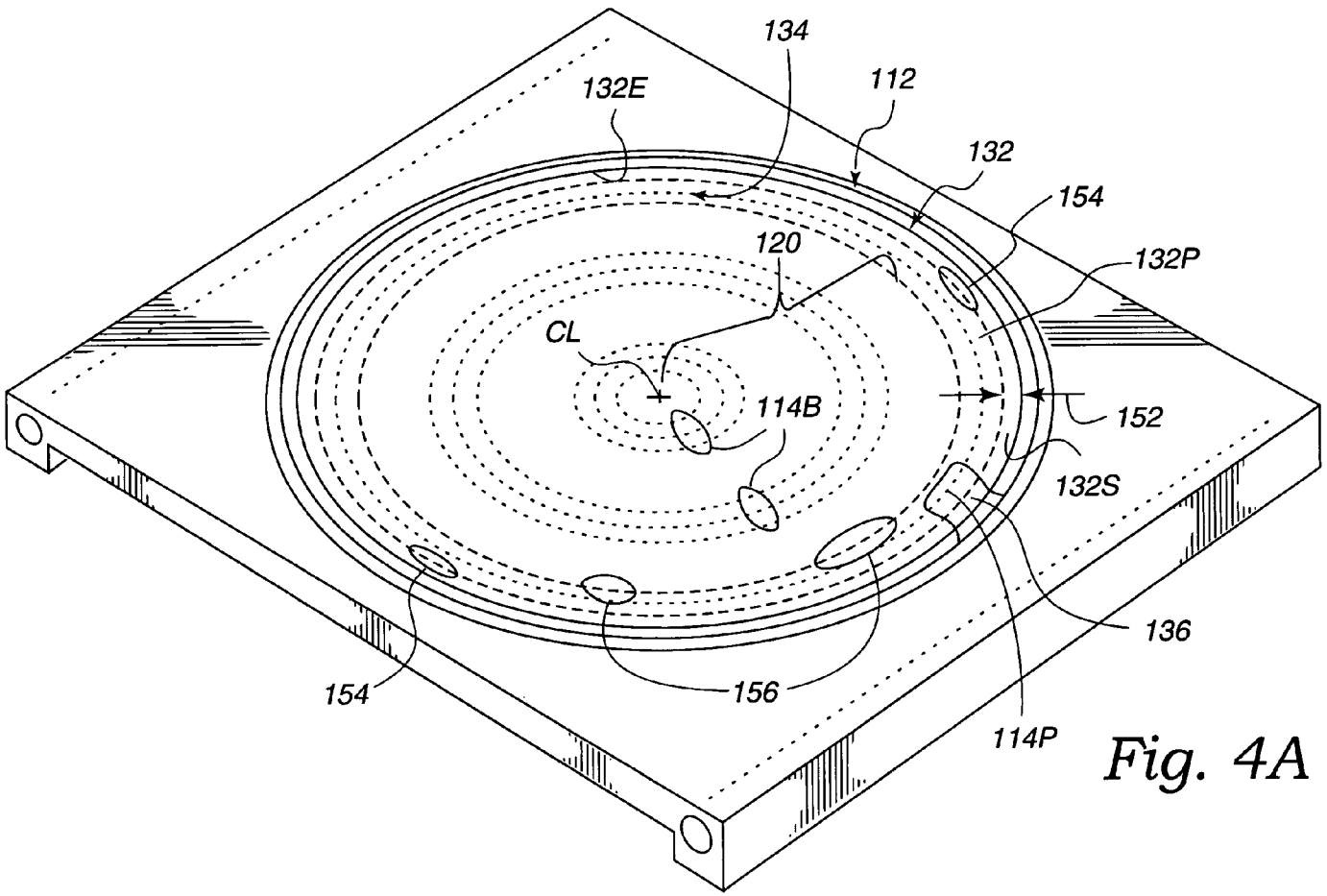
FIG. 4A shows one embodiment of the platen of FIG. 2 provided with the one localized fluid-pressure platen zone.

FIG. 4A shows one embodiment of the platen 112 provided with the one localized fluid-pressure platen zone 134. The membrane 132 is shown cut-away to illustrate the plurality of holes 114P (shown as dots). In this embodiment, the membrane 132 may be configured in one piece that extends from an outer edge 132E inwardly to the center CL of the platen 112. The first section 132S is secured to the top surface of the platen 112. The extent of the first section 132S in the direction of a radius is indicated by dimension lines 152. The cut-away of the first section 132S of the membrane 132 also reveals the fastener 136 that secures the first section 132S to the top surface. A circular ring (identified in part by encircling loops 154) is shown as a dashed line and indicates an inner extent of the first section 132S. The pocket 132P of the membrane 132 extends radially inward further than the circular ring 154 and covers all of the plurality of holes 114P that supply the fluid-pressure fluid 116P to provide the pressures P2. A second circular ring (identified by the encircling loops 156) shown as a dashed line indicates an inner extent of the pocket 132P. At the second ring 156 the membrane 132 is again secured to the top surface of the platen 112 and as-secured extends radially inward to the center CL covering all of the rest of the top surface of the platen 112 except for the plurality of holes 114B that supply the fluid-bearing fluid 116B. Those holes 114B are shown arranged in an exemplary six circular (or annular) paths identified by the loops at the ends of the lead lines of the reference "114B". These holes 114B extend through the membrane 132 to provide the fluid-bearing.

It may be appreciated that the one localized fluid-pressure platen zone 134 shown in FIG. 4A thus extends in a circular (or annular) path that generally corresponds to (or is closely adjacent to) the outer edge of the wafer 104. In this manner, as described above with respect to FIG. 3C, the expanded pocket 132P may cause the localized fluid-pressure zone 140 and the exit gap 144 to have a ring-like configuration that also generally corresponds to (or is closely adjacent to) the outer edge of the wafer 104. As a result, there may be an increase or decrease in the removal of material from the wafer 104 at a ring-like region of the wafer according to the respective positive or negative value of the pressure P2. It may also be understood that when the one pocket 132P having the exemplary annular configuration expands into the fluid-bearing gap 124 and the value of the exit gap 144 becomes less than the value of the fluid-bearing gap 124, the once freely-flowing fluid-bearing fluid 116B will be restricted as the fluid-bearing fluid 116B flows toward the exit 128. Moreover, this restriction is all along the ring-like path, such that there will be a significant reduction in the amount of the fluid-bearing fluid 116B that flows out of the exit 128.

Figure 4B:
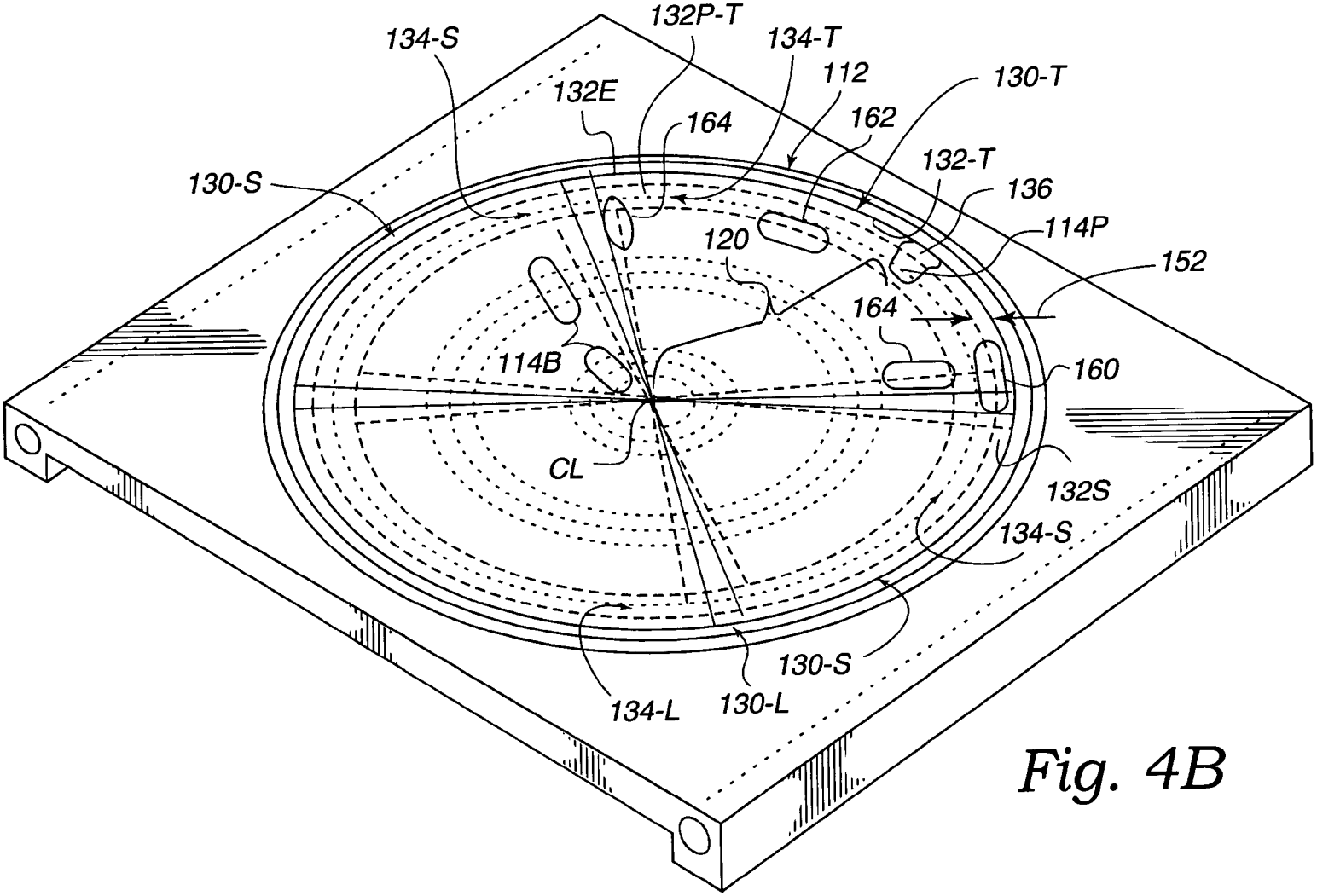
FIG. 4B shows another embodiment of the platen of FIG. 2, which may include a plurality of separate localized fluid pressure platen zones.

FIG. 4B shows another embodiment of the platen 112, which may include a plurality of separate localized fluid pressure platen zones 134. An exemplary four such separate localized fluid pressure platen zones 134 are shown in FIG. 4B. One such localized fluid pressure platen zone is identified as 134-L, where "-L" indicates a leading localized fluid pressure platen zone that first cooperates with the advancing polishing pad 106 moving in the direction 110 (FIG. 2). Another such localized fluid pressure platen zone is identified as 134-T, where "-T" indicates a trailing localized fluid pressure platen zone that last cooperates with the advancing polishing pad 106 moving in the direction 110. Two other such localized fluid pressure platen zone are identified as 134-S, where "-S" indicates side localized fluid pressure platen zones that cooperate with the sides of the advancing polishing pad 106 moving in the direction 110. Except for the location of each such localized fluid pressure platen zone 134 in this embodiment, each localized fluid pressure platen zone is the same, such that the following description of one of these localized fluid pressure platen zones 134 applies to all of the localized fluid pressure platen zones 134.

FIG. 4B is a diagram similar to FIG. 4A, and the localized fluid pressure platen zone 134-T is described as exemplary of all localized fluid pressure platen zones shown in FIG. 4B. The membrane structure 130 of the localized fluid pressure platen zone 134-T is designated 130 with a "-T" to identify the trailing membrane structure. The membrane structure 130-T is configured with one separate membrane 132-T that is separate from the other membranes 132 of the other leading and side membrane structures 130. The membrane structure 130-T is configured with one separate membrane 132-T corresponding to the fluid-pressure platen zone 134-T. In turn, the separate localized fluid-pressure platen zone 134-T will cause a separate localized fluid-pressure zone 140 to form (similar to zones 140H or 140L in respective FIGS. 3C and 3D). FIG. 4A shows the membrane 132-T cut-away to illustrate the localized fluid-pressure platen zone 134-T as including a plurality of the holes 114P. In this embodiment, the membrane 132-T may be configured as one pie (or wedge)-shaped piece that extends from the outer edge 132E inwardly to the center CL of the platen 112, and that has radially-extending edges (see dashed lines 164). The extent of the first section 132S in the direction of a radius is indicated by dimension lines 152. The cut-away of the first section 132S of the membrane 132-T also shows the fastener 136 that secures the first section 132S to the top surface. An arc (identified in part by an encircling loop 160) is shown as a dashed line and indicates an inner extent of the first section 132S. The pocket 132P-T of the membrane 132-T extends radially inwardly further than the arc 160 and covers all of the respective plurality of holes 114P that are located corresponding to the arc shape of the localized fluid pressure platen zone 134-T. A second arc (identified in part by an encircling loop 162) is shown as a dashed line and indicates an inner extent of the pocket 132P-T. At the second arc 162 the membrane 132-T is again secured to the top surface of the platen 112 and as-secured extends radially inwardly to the center CL covering a wedge-shaped portion of the rest of the top surface of the platen 112 except for the plurality of holes 114B that supply the fluid-bearing fluid 116B through the membrane 132-T. Those holes 114B are shown arranged in an exemplary six arc-like paths identified by the loops at the ends of the lead lines of the reference "114B".

It may be appreciated that the one localized fluid-pressure platen zone 134-T shown in FIG. 4B thus extends in an arcuate path that generally parallels a portion of the outer edge of the wafer 104. In this manner, as described above with respect to FIG. 3C the expanded pocket 132P may cause the localized fluid-pressure zone 140-T and the exit gap 144-T to have an arcuate configuration that also generally corresponds to the portion of the outer edge of the wafer 104. As a result, there may be an increase or decrease in the removal of material from the wafer 104 at an arc-like region of the wafer (according to the value of the pressure P2). It may also be understood that when the one pocket 132P having the exemplary arcuate configuration expands into the fluid-bearing gap 124 and the value of the exit gap 144 becomes less than the value of the fluid-bearing gap 124 along the arcuate extent of that one pocket 132P, the once freely-flowing fluid-bearing fluid 116B will be restricted as the fluid-bearing fluid 116B flows toward the portion of the exit gap 128 that is restricted by the one pocket 132P. Although this restriction is not all along the complete ring-like path as in the embodiment shown in FIG. 4A, there will still be a significant reduction in the amount of the fluid-bearing fluid 116B that flows out of the exit gap 128. Further, when each pocket 132P of the localized fluid-pressure zones 140-T, 140-L, and 140-S is expanded, though possibly at different pressures P2, for example, there will be a more significant reduction in the amount of the fluid-bearing fluid 116B that flows out of the exit gap 128 than when only one arcuate pocket 132P restricts the fluid-bearing fluid 116B.

It may also be understood that by providing at least two separate localized fluid-pressure platen zones 134 (and corresponding at least two separate localized fluid-pressure zones 140 shown in FIGS. 3C and 3D), a different polishing pressure may be applied by each of the two separate respective localized fluid-pressure zones 140-T, 140-L and 140-S. Such different polishing pressures may result from the exemplary positive and negative pressures +P2 and −P2, for example, applied to different holes 114P. Alternatively, a positive pressure +P2 or a negative pressure −P2 may be applied to each of two holes 114P, where each positive pressure +P2 or negative pressure −P2 has a different value. Provision of these different polishing pressures may be referred to as providing "differential" polishing pressures on the corresponding regions of the wafer 104. With respect to the embodiment shown in FIG. 4A, the "differential" polishing pressure results in an ability to polish the wafer 104 according to a removal profile that is different at different radial distances from the center of the wafer 104. With respect to the embodiment shown in FIG. 4B, the "differential" polishing pressure results in an ability to polish the wafer 104 according to a removal profile that is different at different angular locations around the wafer 104. To provide manipulation of the removal profile at more different radial distances, more localized fluid-pressure platen zones 134 may be provided. To provide manipulation of the removal profile at more angular locations around the center CL of the wafer 104, more separate localized fluid-pressure zones 140 may be provided as shown in FIG. 4B, each localized fluid-pressure zone 140 having a smaller angle around the center CL between the edges 164.

Figure 5:
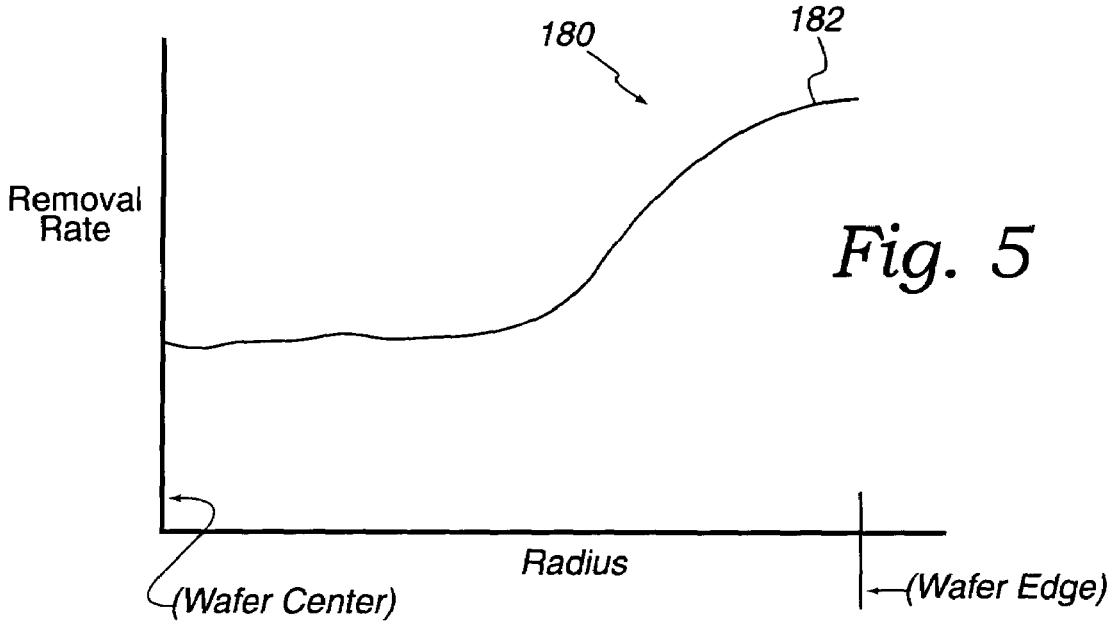
FIG. 5 shows a graph illustrating a removal profile for a wafer in accordance with one embodiment of the present invention.

FIG. 5 shows a graph 180 illustrating a removal profile for a wafer in accordance with one embodiment of the present invention. The graph 180 has a y-axis showing normalized removal rate and an x-axis representing center to edge distance of the wafer (i.e., radius). The graph 180 depicts the removal profile at a particular angular location around the wafer 104. In prior art platens, difficulties arose especially in the wafer area between a radius of about 20 mm to about 88 mm from the center of the wafer. In those areas, in one example, due to non-uniform oxide deposition on the wafer, oxide deposition thicknesses can vary. By the present invention, by configuring the size and location of a plurality of the separate membrane structures 130 (e.g., structures 130-T, 130-L, and 130-S) with the separate pockets 132P and the resulting separate localized fluid pressure platen zones 134 shown for example in FIG. 4B), and the corresponding separate localized fluid pressure zones 140 (shown for example in FIG. 3C), polishing of almost all regions of the exposed surface of the wafer 104 may be adjusted to provide a different removal rate at different radial and angular regions of the wafer. The line 182 illustrates a desired removal profile that may be achieved by the present invention in CMP processing. The line 182 may be defined according to the characteristics of the CMP process. Also, the line 182 may take into account a wafer thickness profile. The line 182 of FIG. 5 illustrates an exemplary desired removal profile in CMP processing of a wafer having a thickness profile where the oxide deposition thickness is thicker at an edge region of the wafer and thinner at the center region of the wafer 104 at a particular angular location around the wafer 104. Therefore, as shown by the graph 180, the removal rates at different radial and angular regions of the wafer may be adjusted to correspond to how thick the oxide deposition is in that region and at that angle. In other words, polishing pressure may be varied over different zones of the platen 112 so regions of the unpolished wafer 104 with thick oxide deposition can have a higher removal rate than regions of the unpolished wafer 104 with thin oxide deposition. As a result, by use of the platen 112 described herein, a wafer 104 with a non-uniform oxide layer thickness may be planarized to form a substantially uniform oxide layer thickness. It should be understood that although optimizing the planarization of an oxide layer is described, the platen 112 may be utilized to planarize any other suitable type of material. Therefore, use of the platen 112 described herein leads to improved wafer production efficiency and lower wafer production costs. It should be appreciated that the above conditions are only exemplary in nature and other polishing conditions may be used with the apparatus described herein to obtain an optimized removal profile while reducing usage of the fluid 116 and taking into account characteristics of the CMP process.

Figure 6:
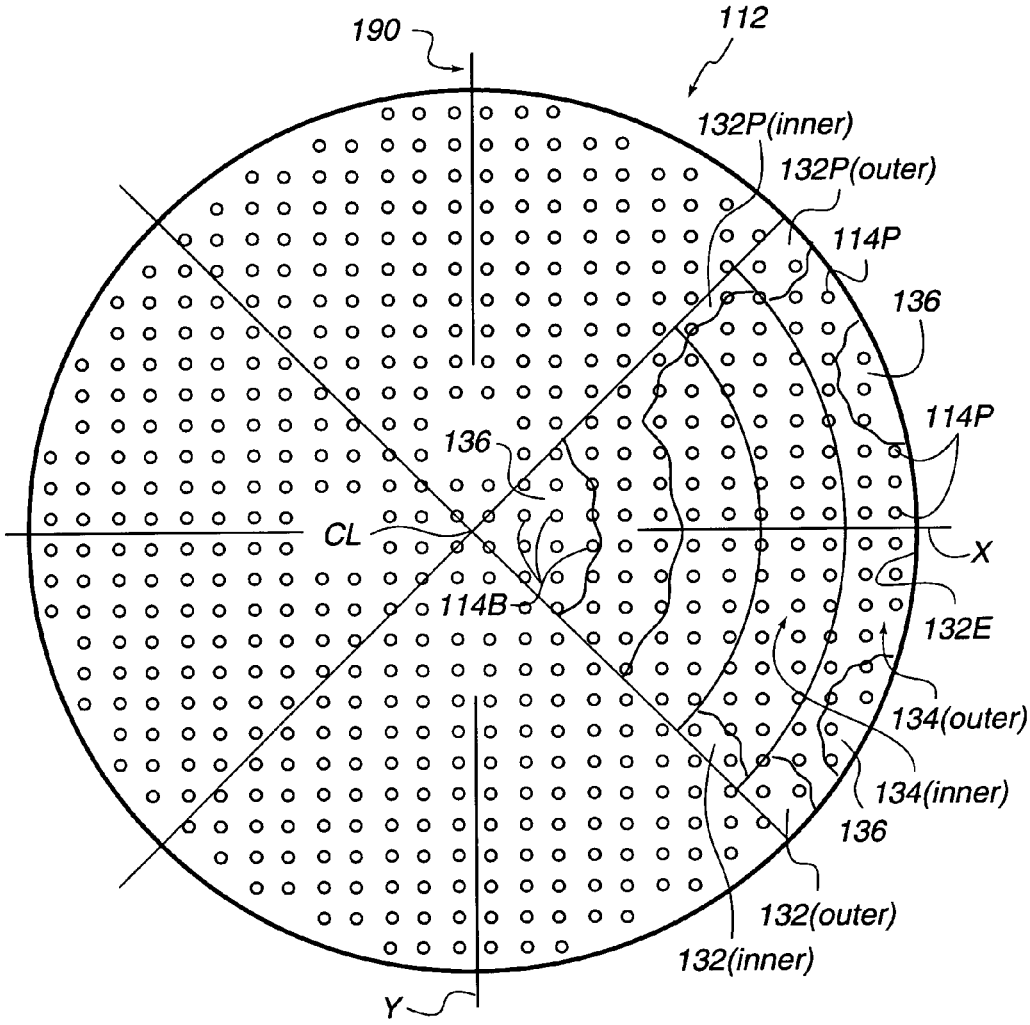
FIG. 6 shows an array of the holes in a portion of the platen, wherein the holes are referenced to a rectangular coordinate system.

FIG. 6 shows another arrangement of the holes 114 in the platen 112. For ease of illustration, only the holes 114, the membrane 132 and the fastener 136 are shown. Rather than the circular or arcuate hole arrangement of FIGS. 4A and 4B, FIG. 6 shows a rectangular coordinate system (or grid) 190 on which the holes 114 may be arranged. The coordinate system 190 includes orthogonal x and y axes. The platen 112 is provided with the membrane structure, which is cut-away to show the holes 114B of the fluid-bearing, and to show the holes 114P of two exemplary localized fluid-pressure platen zones 134 (inner) and 134 (outer). These holes 114B and 114P are arranged with respect to the x and y axes to form a linear array in the directions of the x and y axes. In this embodiment, the membrane 132 may also be configured in one piece that extends from an outer edge 132E inwardly to the center CL of the platen 112. However, the membrane 132 may configured to provide one pocket 132P (outer) and one pocket 132P (inner) that may be separately operated in the manner described above, e.g., with respect to FIGS. 3C and 3D. Inside of the inner pocket 132P (inner) the membrane 132 is secured to the top surface of the platen 112 and as-secured extends in the directions of the x and y axes covering all of the rest of the top surface of the platen 112 except for the plurality of holes 114B that supply the fluid-bearing fluid 116B. Those holes 114B are shown arranged in the grid pattern along the x and y axes. It may be appreciated that each of the two localized fluid-pressure platen zones 134 (outer) and 134 (inner) shown in FIG. 6 may also generally extend in a circular or annular path that generally corresponds to (or is closely adjacent to) the outer edge of the wafer 104. In this manner, as described above with respect to FIG. 3C, each of the expanded pockets 132P outer and 132P inner may cause a corresponding localized fluid-pressure zone 140 and the exit gap 144 to generally have a ring-like configuration that also generally corresponds to (or are closely adjacent to) the outer edge of the wafer 104. As a result, there may be an increase or decrease in the removal of material from the wafer 104 at a generally-ring-like region of the wafer according to the respective positive or negative value of the pressure P2 applied separately to each localized fluid-pressure platen zone 134, or along another path having another desired shape not specifically related to the wafer edge.

It may also be understood that in this embodiment, only one pocket 132P (outer) or 132P (inner), having the exemplary generally annular configuration, need expand into the fluid-bearing gap 124 so that the value of the exit gap 144 will become less than the value of the fluid-bearing gap 124. Thus, only one pocket 132P (outer) or 132P (inner) need be used to restrict the once freely-flowing fluid-bearing fluid 116B as the fluid-bearing fluid 116B flows toward the exit 128. Moreover, this restriction will also be all along the generally ring-like path, such that there will be a significant reduction in the amount of the fluid-bearing fluid 116B that flows out of the exit gap 128.

Figure 7:
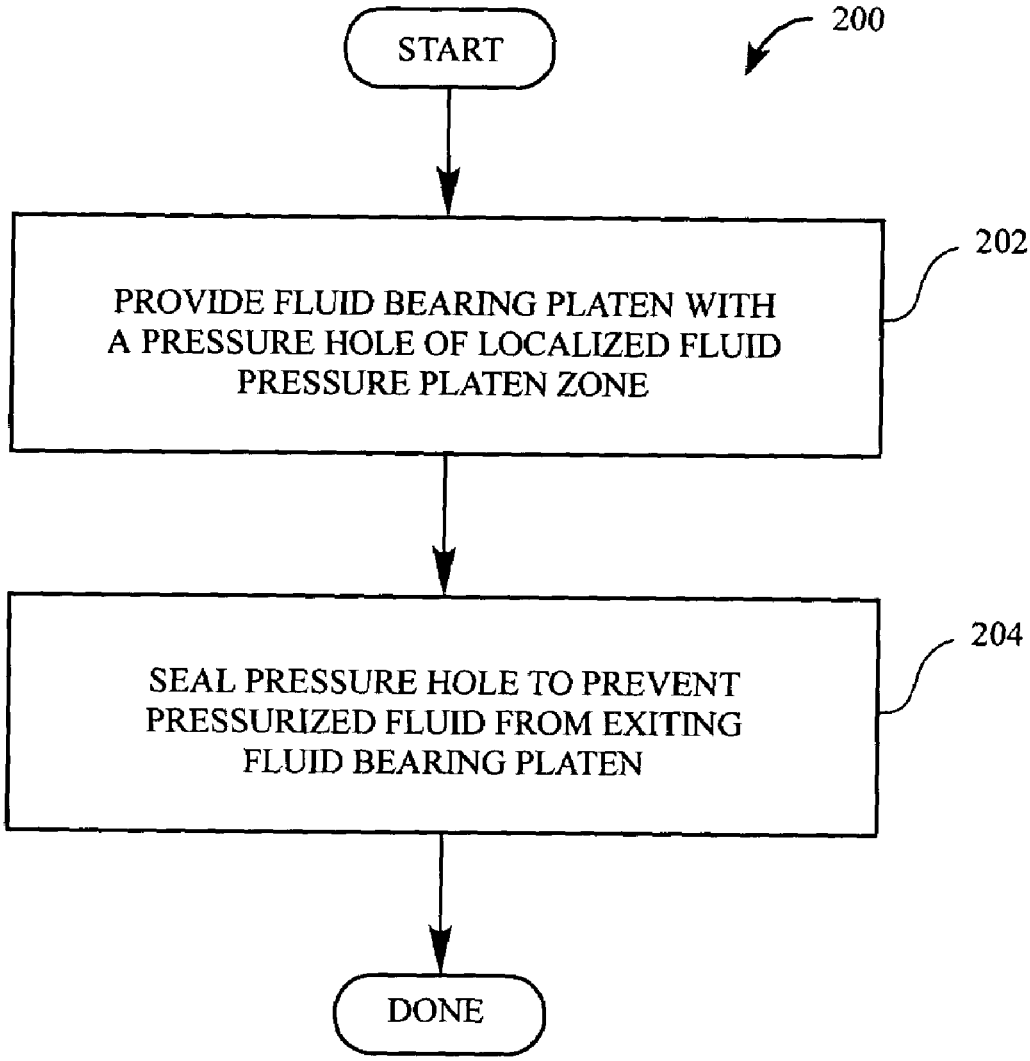
FIG. 7 illustrates a flowchart that defines a functionality of one embodiment of a method of the present invention, wherein the method limits consumption of fluid.

FIG. 7 illustrates a flowchart 200 that defines a functionality of the platen 112 in accordance with one embodiment of the present invention. The method may be used to provide a fluid-bearing platen 112 of a CMP apparatus 100, for example, in which the consumption of fluid 116 is limited. The method begins with an operation 202 in which the fluid-bearing platen 112 is provided with at least one of the holes (or apertures), such as the holes 114P. The holes 114P may be arranged as shown in FIG. 4A, 4B, or 6 to define at least one localized fluid pressure platen zone 134, and the resulting localized fluid pressure zone 140. The localized fluid pressure platen zone 134 may, for example, be the plurality of localized fluid pressure platen zones 134 shown in FIG. 4B or 6, for example.

After operation 202, the method moves to operation 204 of sealing of the at least one hole 114P with a flexible membrane 132 secured around the at least one hole 114P. The sealed hole 114P prevents the fluid 116P of the at least one localized fluid pressure platen zone 134 from exiting the fluid-bearing platen. When there are many localized fluid pressure platen zones 134, each hole 114P of a particular localized fluid pressure platen zone 134 is sealed with a respective flexible membrane 132 that is secured around the at least one hole 114P (or around a group of holes 114P) to prevent the fluid 116P of that one localized fluid pressure zone 134 from exiting the fluid-bearing platen 112. The sealing is achieved in the above-described manner so that a pocket 132P is over the holes 114P of a particular localized fluid pressure zone 134.

Figure 8:
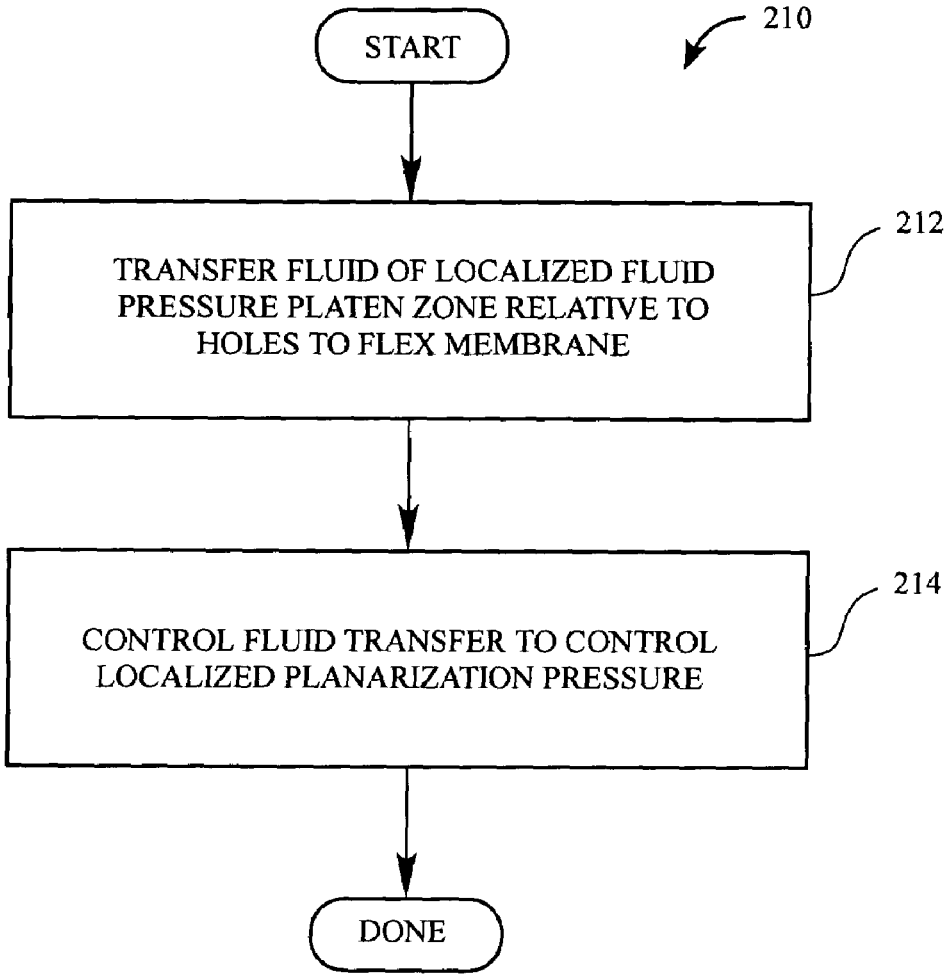
FIG. 8 illustrates a flowchart that defines a functionality of another embodiment of a method of the present invention, wherein the method limits consumption of fluid and controls a localized planarization pressure applied via a polishing pad to a wafer.

FIG. 8 illustrates a flowchart 210 that defines a functionality of the platen 112 in accordance with another embodiment of the present invention. In performing the method, a fluid-bearing platen 112 is used and has the configuration described with respect to the method of FIG. 7. Thus, the fluid-bearing platen 112 is provided with the holes 114P corresponding to one or more localized fluid-pressure platen zones 134. The holes 114P of one localized fluid-pressure platen zone 134 are sealed with a flexible membrane 132. The membrane 132 is secured around at least one hole 114P (or around the group of holes 114P) to prevent the fluid 116P of the at least one localized fluid pressure zone 134 from exiting the fluid-bearing platen. The method begins with an operation 212 of transferring the fluid 116P of at least one localized fluid pressure platen zone 134 relative to the holes 114P to cause the membrane 132P to flex.

The method moves to an operation 214 of controlling the fluid transferring operation 212 to control a localized planarization pressure applied via the polishing pad 106 to a workpiece such as the wafer 104. Each of the pockets 132P is configured in the above-described manner to prevent the fluid-pressure fluid 116P from exiting the platen 112 in a freely-flowing manner. Also, the platen 112 used to perform the method of flowchart 210 may have been made by the sealing operation 204, such that one or more localized fluid-pressure platen zones 134 shown in FIG. 4A, for example, may extend in the circular path that generally corresponds to the outer edge of the wafer 104. In this manner, as described above the expanded pocket 132P may cause the resulting localized fluid-pressure zone 140 and the exit gap 144 to have a ring-like configuration that also generally corresponds to the outer edge of the wafer 104. As a result of the controlling operation 214, there may be an increase or decrease in the actual removal of material from the wafer 104 at a ring-like region of the wafer 104 according to the value of the pressure P2. Alternatively, by using the platen 112 configured as shown in FIG. 4B, there may be an increase or decrease in the actual removal of material from the wafer 104 at an arc-shaped region of the wafer 104 according to the value of the pressure P2. Operation 214 adjusts the pressure P2 to have a value to optimize the polishing profile. Therefore, by increasing polishing pressure on certain regions of the wafer 104 while decreasing polishing pressure on other regions of the wafer, the removal profile of the wafer 104 may be optimally controlled. In circumstances where the CMP process characteristics normally provide an undesired high or low removal rate (e.g., at a specific location on the wafer), the removal profile may be manipulated so that the removal profile may compensate for, or offset, the undesired characteristic. Similarly, in circumstances where deposition of materials on the unpolished wafer 104 has led to non-uniform thickness of the deposited layer, the removal profile may be manipulated so removal rates in areas of thickness may be increased while removal rates in areas of thinness may be decreased. Therefore, a substantially planar surface may result after the polishing has been completed. In one embodiment, each of the local fluid-pressure platen zones 134 may be configured by placement of the corresponding holes 114P and the membranes 132. Each such localized fluid-pressure platen zone 134 may be independently controlled by the source 118 by selecting a suitable pressure P2 for the localized fluid-pressure platen zone 134. Moreover, at any suitable time, the value of the pressure P2 for the local fluid-pressure platen zones 134 may be changed by the source 118 so that polishing pressure may be applied to or removed from or varied at almost any wafer region at almost any time. Thus, the removal profile may be manipulated by the method of the present invention. This manipulation of the removal profile may be provided while having the advantages of both offsetting the undesired CMP process characteristics and limiting the consumption of fluid 116, for example. Thus, when one exemplary pocket 132P having the exemplary annular configuration expands into the fluid-bearing gap 124 and the value of the exit gap 144 becomes less than the value of the fluid-bearing gap 124, the once freely-flowing fluid-bearing fluid 116B will be restricted as the fluid-bearing fluid 116B tends to flow freely flows toward the exit gap 128. Moreover, this restriction may be all along the exemplary ring-like path, such that there will be a significant reduction in the amount of the fluid-bearing fluid 116B that flows out of the exit gap 128. In this manner, the method of the present invention limits consumption of the fluid 116 in the fluid-bearing platen 112 of the CMP apparatus 100.

It should also be appreciated that any suitable type of polishing pad may be effectively utilized with the platen 112 described herein, including polymeric polishing belts, stainless steel supported polishing belts, multi-layer supported polishing belts, etc. Therefore, the platen 112 can enhance wafer polishing uniformity in a wide variety of CMP systems.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A platen for use in a chemical mechanical planarization (CMP) system, comprising:

a structure configured with at least two apertures, one or more of the at least two apertures defining at least one localized fluid-pressure platen zone, one or more of the at least two apertures defining at least one fluid-bearing platen zone configured to allow a flow of fluid-bearing fluid, the fluid-bearing fluid having a tendency to freely-flow from the at least one fluid-bearing platen zone out of the platen; and a membrane covering all of the one or more of the at least two apertures that define each of the at least one localized fluid-pressure platen zones, the membrane being configured with a first section sealed to the structure around the all of the one or more of the at least two apertures defining the at least one localized fluid-pressure platen zone so that in response to fluid of the respective at least one localized fluid-pressure platen zone, the sealed membrane is extendable into the fluid-bearing fluid of the at least one fluid-bearing platen zone.

2. A platen as recited in claim 1, wherein:

the membrane configured with the sealed first section is sealed fluid-tight around the all of the one or more of the at least two apertures.

3. A platen for use in a chemical mechanical planarization (CMP) system, comprising:

a structure configured with at least two apertures, one or more of the at least two apertures defining at least one localized fluid-pressure platen zone, one or more of the at least two apertures defining at least one fluid-bearing platen zone configured to allow a flow of fluid-bearing fluid, the fluid-bearing fluid having a tendency to freely-flow from the at least one fluid-bearing platen zone out of the platen; and a membrane covering the one or more of the at least two apertures that define each of the at least one localized fluid-pressure platen zones, the membrane being configured so that in response to fluid of the respective at least one localized fluid-pressure platen zone, the membrane is extendable into the fluid-bearing fluid of the at least one fluid-bearing platen zone, the membrane being configured with a first section secured to the structure around the one or more of the at least two apertures, the membrane being configured with a second section surrounded by the first section, and the extendable configuration of the membrane comprises the second section having a flexible characteristic for movement relative to the respective one or more of the at least two apertures in response to the fluid of the respective at least one localized fluid-pressure platen zone, the movement of the second section extends the second section into the flow of the fluid-bearing fluid.

4. A platen as recited in claim 3, wherein:

the movement of the second section relative to the respective one or more of the at least two apertures is movement away from the respective one or more of the at least two apertures in response to the fluid of the at least one localized fluid-pressure platen zone.

5. A platen as recited in claim 3, wherein:

the movement of the second section relative to the respective one or more of the at least two apertures is movement toward the respective one or more of the at least two apertures in response to the fluid of the at least one localized fluid-pressure platen zone.

6. A platen as recited in claim 1, wherein:

the one or more of the at least two apertures defining at least one localized fluid-pressure platen zone comprises at least two apertures each defining one of the localized fluid-pressure platen zones;

the membrane covers the one or more of the two apertures defining one of the localized fluid-pressure platen zones; and the platen comprises a second membrane covering one or more other of the at least two apertures, those other apertures define a second of the localized fluid-pressure platen zones, the second membrane is also configured to be extendable in response to fluid of the respective second localized fluid-pressure platen zone, the configuration of the second extendable membrane permits extension of the second membrane into the flow of the fluid-bearing fluid;

the two extendable membranes cooperate to reduce the tendency of the fluid-bearing fluid of the localized fluid-bearing platen zones to freely-flow out of the platen.

7. A platen as recited in claim 1, wherein:

the at least one localized fluid-pressure platen zone is defined by a plurality of the at least two apertures, the plurality of the at least two apertures are organized in separate groups, each separate group corresponding to a different one of the localized fluid-pressure platen zones; and the membrane comprises a separate membrane covering each separate group of the plurality of the at least two apertures, each separate membrane is configured so that the separate membranes are separately extendable into the flow of the fluid-bearing fluid in response to fluid-pressure fluid of a respective one of the localized fluid-pressure platen zones.

8. A platen for use in a chemical mechanical planarization (CMP) system, comprising:

at least one fluid-bearing platen zone having a plurality of fluid-bearing outlets for supplying fluid-bearing fluid, the at least one fluid-bearing platen zone being disposed below and being capable of providing fluid-bearing pressure on a polishing pad; and at least one fluid-pressure platen zone comprising at least one fluid-pressure port for transferring fluid-pressure fluid relative to the at least one fluid-bearing platen zone and the polishing pad, the at least one fluid-pressure platen zone being disposed below the polishing pad, each of the at least one fluid pressure platen zones further comprising a member configured to define a flexible pocket covering the at least one fluid-pressure port of the respective fluid-pressure platen zone to prevent the fluid-pressure fluid from freely-flowing relative to the respective fluid-bearing zone, the flexible pocket of each of the at least one fluid-pressure platen zones being configured to extend into the fluid-bearing fluid supplied from the fluid-bearing outlets.

9. A platen as recited in claim 8, wherein:

the fluid-pressure fluid transferred by the at least one fluid-pressure port flexes the respective membrane to configure the respective pocket; and the configuration of each respective flexible pocket to extend into the fluid-bearing fluid restricts flow of the fluid-bearing fluid from the platen.

10. A platen as recited in claim 9, wherein a value of fluid-pressure of the fluid-pressure fluid transferred by the at least one fluid-pressure port is a static pressure value that is controlled relative to a value of a pressure of the fluid-bearing fluid.

11. A platen as recited in claim 8, wherein a value of fluid-pressure of the fluid-pressure fluid in each of the flexible pockets is a static pressure having a value in a range of pressure from about 1 to 2 psi greater than a value of a pressure of the fluid-bearing fluid.

12. A platen as recited in claim 8, wherein:

the free-flow of the fluid-bearing fluid is a tendency to freely-flow from the at least one fluid-bearing zone and out of the platen; and the extension of each flexible pocket into the fluid-bearing fluid restricts the tendency of the fluid-bearing fluid to freely-flow out of the platen.

13. A platen as recited in claim 8, wherein:

the fluid-bearing outlets of the at least one fluid-bearing zone are located at a position corresponding to a central area of a wafer to be polished so that the fluid-bearing fluid tends to freely-flow in a fluid-bearing gap away from the position to provide the fluid-bearing pressure to the polishing pad; and the fluid-pressure fluid transferred relative to the at least one fluid-pressure port of the at least one fluid-pressure zone is capable of deforming each member into the fluid-bearing gap to restrict the tendency of the fluid-bearing fluid to freely-flow in the fluid-bearing gap away from the position while the fluid-bearing fluid still provides the fluid-bearing pressure to the polishing pad.

14. A platen for use in a chemical mechanical planarization (CMP) system in which a polishing pad is configurable to apply selected polishing pressures to different areas of a wafer to be planarized, the platen comprising:

a fluid-bearing structure configured with a first plurality of apertures for transferring polishing pressure control fluid, the apertures being configured to define a plurality of localized fluid-pressure platen zones for applying selectable polishing pressure control pressures to the polishing pad; and a membrane corresponding to each localized fluid-pressure platen zone, each membrane covering respective ones of the apertures corresponding to a respective one of the localized fluid-pressure platen zones, each membrane being sealed to the fluid-bearing structure around the respective ones of the apertures to separate the polishing pressure control fluid of the respective localized fluid-pressure zone from the fluid-bearing structure, the sealing of each membrane enabling different selectable localized fluid pressures to be applied to each localized fluid-pressure platen zone to provide differential polishing pressure control pressures to the polishing pad;

the fluid-bearing structure being further configured with a second plurality of apertures for supplying fluid-bearing fluid between the respective membranes and the polishing pad.

15. A platen as recited in claim 14, wherein:

the second plurality of apertures is configured to define a second plurality of localized fluid-bearing zones for supplying fluid-bearing fluid to support the polishing pad, the fluid-bearing structure is further configured with a gap between the respective membranes and the polishing pad, the gap is normally open to permit relatively free-flow of the fluid-bearing fluid to exit the fluid-bearing structure; and each of the membranes is sealed to the fluid-bearing structure along the gap and responds to the polishing pressure control fluid from one or more of the apertures of the respective first plurality of apertures to restrict the gap and limit the flow between the respective membranes and the polishing pad of the fluid-bearing fluid from the fluid-bearing structure.

16. A platen as recited in claim 15, wherein:

each sealed membrane responds to the polishing pressure control fluid by becoming inflated to define a pocket that extends at least partially across the gap to limit the flow of the fluid-bearing fluid from the fluid-bearing structure.

17. A platen as recited in claim 14, wherein:

the polishing pad is configured as an endless belt;

the fluid-bearing fluid from the second plurality of apertures of the fluid-bearing structure provides a gap filled with the fluid-bearing fluid for supporting the endless belt spaced from the platen; and each membrane is reconfigured by the polishing pressure control fluid received from the respective first plurality of apertures of the plurality of the respective localized fluid-pressure platen zone so that the reconfigured membrane enters the gap and restricts the flow of the fluid-bearing fluid through the gap.

18. A method of limiting consumption of fluid by a platen of a chemical mechanical planarization system, comprising the operations of:

providing the platen with a first aperture communicating with a self-contained localized fluid-pressure platen zone;

providing the platen with a second aperture for defining at least one fluid-bearing platen zone;

admitting fluid-bearing fluid into the second aperture, the fluid-bearing fluid tending to flow from the second aperture and out of the platen; and admitting fluid-pressure fluid into the first aperture so that the self-contained localized fluid-pressure platen zone separates the fluid-pressure fluid of the localized fluid-pressure zone from the fluid-bearing platen zone.

19. A method as recited in claim 18, wherein the platen defines a gap between a polishing pad and the platen, wherein:

the admitting fluid-pressure fluid operation comprises the operations of:

transferring the fluid of the localized fluid-pressure platen zone relative to the first aperture to cause the self-contained localized fluid-pressure platen zone to apply a self-contained localized planarization pressure to the polishing pad in a fluid-tight manner; and controlling the transferring operation to control the self-contained localized planarization pressure applied via the polishing pad to a workpiece and to control the limited flow of the fluid-bearing fluid out of the platen.

20. A method, of limiting consumption of fluid by a platen of a chemical mechanical planarization system, comprising the operations of:

providing the platen with a first aperture communicating with a self-contained localized fluid-pressure platen zone;

providing the platen with a second aperture for defining at least one fluid-bearing platen zone, wherein the platen is a fluid-bearing platen and defines a fluid-bearing gap between a polishing pad and the fluid-bearing platen, the fluid-bearing gap extending outwardly from a central platen zone to the self-contained localized fluid-pressure zone;

configuring the fluid-bearing platen with at least one self-contained localized fluid-pressure zone outwardly of the central platen zone and having a flexible membrane; and admitting fluid-bearing fluid into the second aperture, the fluid-bearing fluid tending to flow from the second aperture and out of the platen; and admitting fluid-pressure fluid into the first aperture so that the localized fluid-pressure platen zone limits the flow of the fluid-bearing fluid out of the platen, wherein the admitting fluid-pressure fluid operation is controlled to cause the membrane to control a localized fluid-pressure applied to the polishing pad and a resulting localized planarization pressure applied via the polishing pad to a workpiece, wherein the membrane enters the gap to restrict the flow of the fluid-bearing fluid through the fluid-bearing gap and out of the platen.

* * * * *